US005465029A

United States Patent [19]

Hanazaki et al.

[11] Patent Number: 5,465,029

[45] Date of Patent: Nov. 7, 1995

[54] POWER CONTROL APPARATUS FOR DISCHARGING LAMP AND METHOD THEREOF

[75] Inventors: Yasumasa Hanazaki; Nobuo Ukita, both of Hyogo, Japan

[73] Assignee: Mitsubishi Denki Kabushiki Kaisha, Tokyo, Japan

[21] Appl. No.: 226,056

[22] Filed: Apr. 11, 1994

[30] Foreign Application Priority Data

Sep. 17, 1993 [JP] Japan ..... 5-231384

[51] Int. Cl.[6] ..... G05F 1/00

[52] U.S. Cl. ..... 315/308; 315/307; 315/224; 315/219; 315/82

[58] Field of Search ..... 315/77, 82, 224, 315/307, 308, 219, DIG. 7

[56] References Cited

U.S. PATENT DOCUMENTS 4,672,271 6/1987 Gear et al. ..... 315/117

5,212,428 5/1993 Sasaki et al. ..... 35/307 X

FOREIGN PATENT DOCUMENTS 4141988 5/1992 Japan .

4301396 10/1992 Japan .

65376 1/1994 Japan .

*Primary Examiner*—Robert J. Pascal

*Assistant Examiner*—Haissa Philogene

[57] ABSTRACT

A discharging lamp lighting apparatus is provided with predicting means for predicting final discharging lamp voltage of a discharging lamp, and discharging lamp control means including a discharging lamp voltage-discharging lamp current corresponding characteristic to instruct current applied to the discharging lamp by discharging lamp voltage fed to the discharging lamp, for performing lighting control by using a value predicted by the predicting means. It is thereby possible to feed the optimal power to the discharging lamp according to a variation in the final discharging lamp voltage due to quality or an operating time, and reduce a time required for stability of luminous flux.

16 Claims, 22 Drawing Sheets

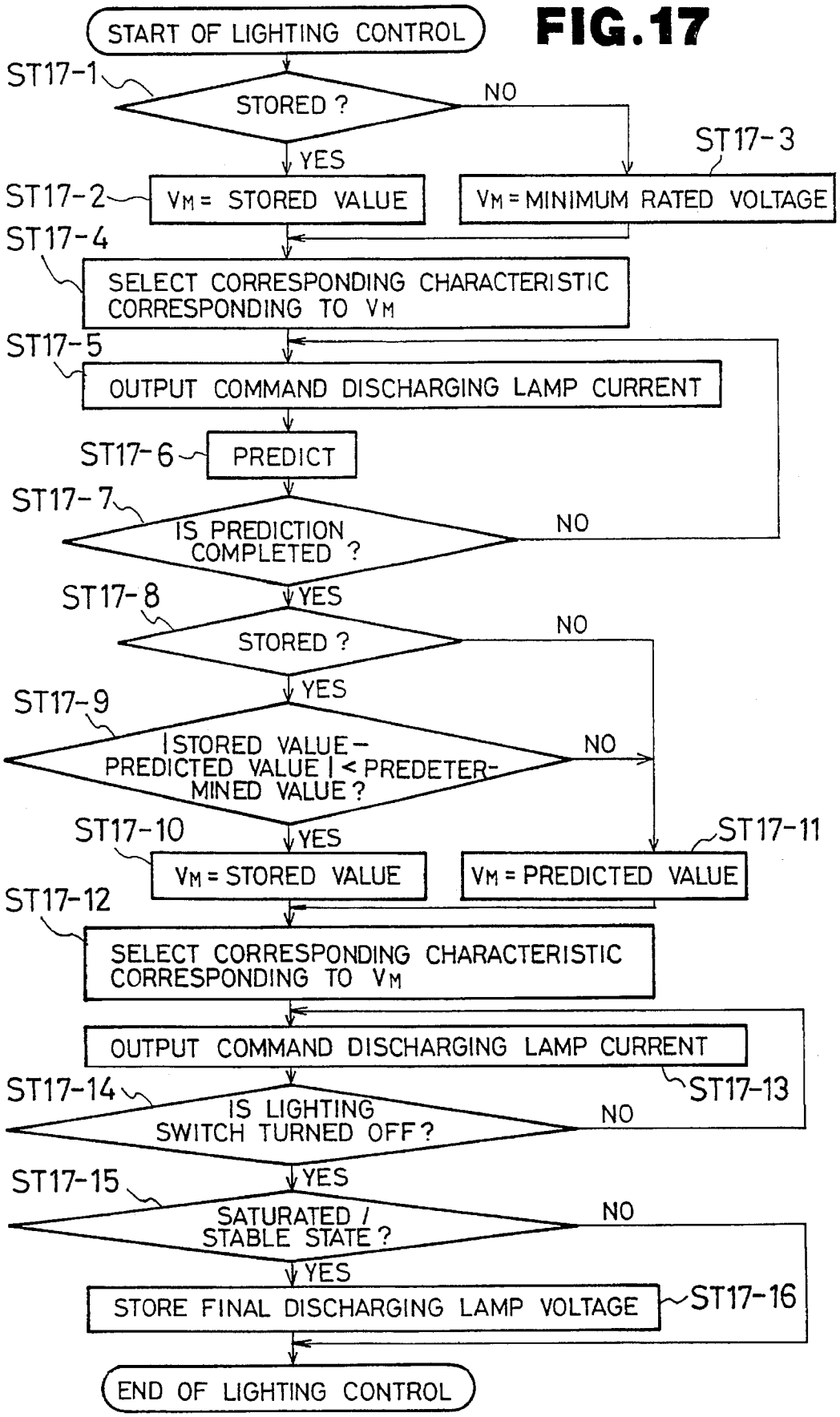
FIG.17
START OF LIGHTING CONTROL
ST17-1
STORED ?
NO
YES
ST17-2
VM = STORED VALUE
ST17-3
VM = MINIMUM RATED VOLTAGE
ST17-4
SELECT CORRESPONDING CHARACTERISTIC CORRESPONDING TO VM
ST17-5
OUTPUT COMMAND DISCHARGING LAMP CURRENT
ST17-6
PREDICT
ST17-7
IS PREDICTION COMPLETED ?
NO
YES
ST17-8
STORED ?
NO
YES
ST17-9
|STORED VALUE − PREDICTED VALUE| < PREDETERMINED VALUE ?
NO
YES
ST17-10
VM = STORED VALUE
ST17-11
VM = PREDICTED VALUE
ST17-12
SELECT CORRESPONDING CHARACTERISTIC CORRESPONDING TO VM
OUTPUT COMMAND DISCHARGING LAMP CURRENT
ST17-13
ST17-14
IS LIGHTING SWITCH TURNED OFF ?
NO
YES
ST17-15
SATURATED / STABLE STATE ?
NO
YES
STORE FINAL DISCHARGING LAMP VOLTAGE
ST17-16
END OF LIGHTING CONTROL

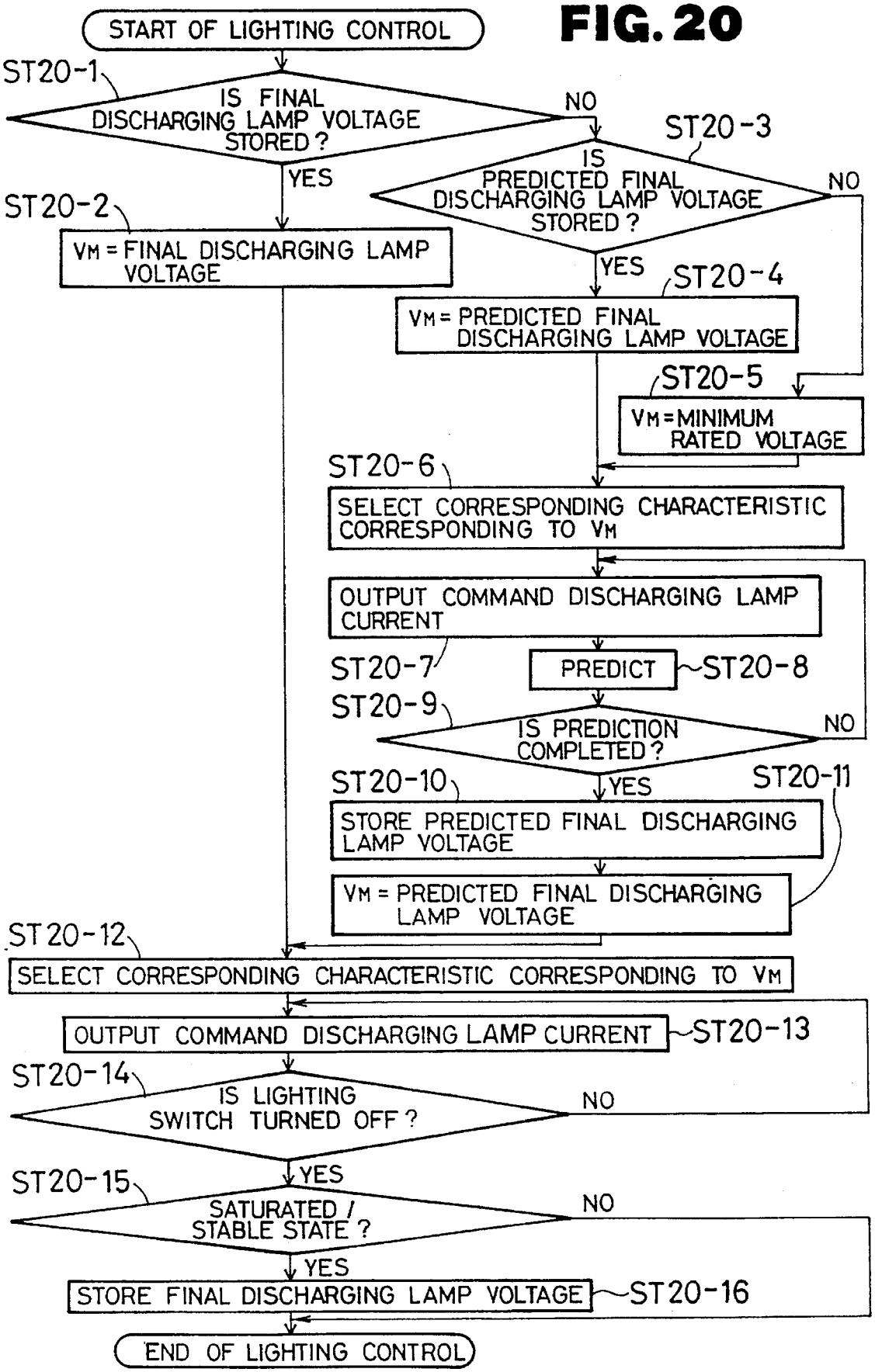
FIG. 20
START OF LIGHTING CONTROL
ST20-1
IS FINAL DISCHARGING LAMP VOLTAGE STORED ?
NO
YES
ST20-3
IS PREDICTED FINAL DISCHARGING LAMP VOLTAGE STORED ?
NO
YES
ST20-2
VM = FINAL DISCHARGING LAMP VOLTAGE
ST20-4
VM = PREDICTED FINAL DISCHARGING LAMP VOLTAGE
ST20-5
VM = MINIMUM RATED VOLTAGE
ST20-6
SELECT CORRESPONDING CHARACTERISTIC CORRESPONDING TO VM
OUTPUT COMMAND DISCHARGING LAMP CURRENT
ST20-7
PREDICT
ST20-8
ST20-9
IS PREDICTION COMPLETED ?
NO
YES
ST20-10
ST20-11
STORE PREDICTED FINAL DISCHARGING LAMP VOLTAGE
VM = PREDICTED FINAL DISCHARGING LAMP VOLTAGE
ST20-12
SELECT CORRESPONDING CHARACTERISTIC CORRESPONDING TO VM
OUTPUT COMMAND DISCHARGING LAMP CURRENT
ST20-13
ST20-14
IS LIGHTING SWITCH TURNED OFF ?
NO
YES
ST20-15
SATURATED / STABLE STATE ?
NO
YES
STORE FINAL DISCHARGING LAMP VOLTAGE
ST20-16
END OF LIGHTING CONTROL

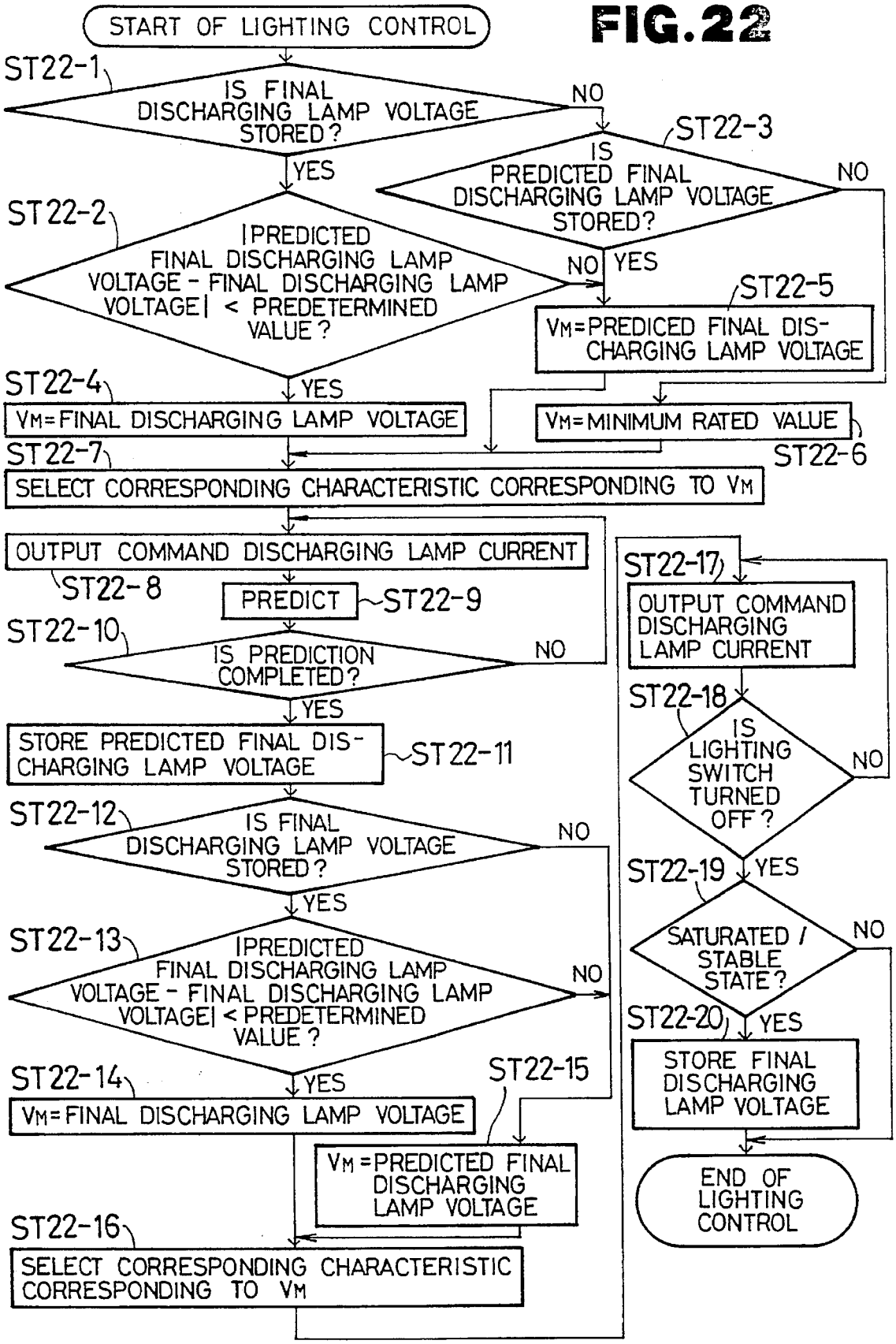
FIG. 22
START OF LIGHTING CONTROL
ST22-1
IS FINAL DISCHARGING LAMP VOLTAGE STORED?
NO
YES
ST22-3
IS PREDICTED FINAL DISCHARGING LAMP VOLTAGE STORED?
NO
YES
ST22-2
|PREDICTED FINAL DISCHARGING LAMP VOLTAGE - FINAL DISCHARGING LAMP VOLTAGE| < PREDETERMINED VALUE?
NO
YES
ST22-5
VM=PREDICED FINAL DISCHARGING LAMP VOLTAGE
ST22-4
VM=FINAL DISCHARGING LAMP VOLTAGE
VM=MINIMUM RATED VALUE
ST22-6
ST22-7
SELECT CORRESPONDING CHARACTERISTIC CORRESPONDING TO VM
OUTPUT COMMAND DISCHARGING LAMP CURRENT
ST22-8
PREDICT
ST22-9
ST22-10
IS PREDICTION COMPLETED?
NO
YES
STORE PREDICTED FINAL DISCHARGING LAMP VOLTAGE
ST22-11
ST22-12
IS FINAL DISCHARGING LAMP VOLTAGE STORED?
NO
YES
ST22-13
|PREDICTED FINAL DISCHARGING LAMP VOLTAGE - FINAL DISCHARGING LAMP VOLTAGE| < PREDETERMINED VALUE?
NO
YES
ST22-14
VM=FINAL DISCHARGING LAMP VOLTAGE
ST22-15
VM=PREDICTED FINAL DISCHARGING LAMP VOLTAGE
ST22-16
SELECT CORRESPONDING CHARACTERISTIC CORRESPONDING TO VM
ST22-17
OUTPUT COMMAND DISCHARGING LAMP CURRENT
ST22-18
IS LIGHTING SWITCH TURNED OFF?
NO
YES
ST22-19
SATURATED / STABLE STATE?
NO
YES
ST22-20
STORE FINAL DISCHARGING LAMP VOLTAGE
END OF LIGHTING CONTROL

POWER CONTROL APPARATUS FOR DISCHARGING LAMP AND METHOD THEREOF

BACKGROUND OF THE INVENTION

1. Field of the Invention

The present invention relates to a discharging lamp lighting apparatus for a high pressure mercury-arc lamp, a metal halide lamp or the like.

2. Description of the Prior Art

In recent years, security and an environmental protection performance of a vehicle has been desired, and individuality of the vehicle has also been important. Desires for improved travelling security and vehicle body design have required, with respect to a head light, an increase in an amount of light and small-sized design. However, in a conventional electric lamp for the vehicle, it has already been difficult to meet such requirements. Hence, adoption of a discharging lamp as a new light source of vehicles is studied.

FIG. 24 is a general view showing a structure of 35 W metal halide lamp which is one kind of discharging lamp 12. In the metal halide lamp, a silica tube 121 is sealed at both ends thereof, and an arc tube 122 is disposed at an intermediate portion of the silica tube 121. The arc tube 122 has tungsten electrodes 123*a*, 123*b* opposed to each other, and the tungsten electrodes 123*a* and 123*b* are connected to external leads 125*a*, 125*b* through molybdenum foils 124*a*, 124*b*. Further, the arc tube 122 is filled with a metallic halide 126 obtained by combining several different metals such as sodium and scandium with iodine, a starting gas (for example, a xenon gas) 127, and mercury 128.

The discharging lamp 12 as described above is significantly different from the conventional electric lamp in that the conventional electric lamp can emit by simply applying voltage to one filament while the discharging lamp uses an arc generated between the electrodes as an emitter and requires a lighting apparatus to control the arc light.

A description will now be given of a part which the lighting apparatus should play by illustrating an emission mechanism of the discharging lamp. The discharging lamp 12 requires high voltage ranging from several kilovolts less than ten to over ten but less than twenty kilovolts for an initial period. Thus, the lighting apparatus generates high voltage to apply the voltage between the tungsten electrodes 123*a* and 123*b* of the discharging lamp 12. Discharge is thereby started between the tungsten electrodes 123*a* and 123*b*, resulting in a current flow between the tungsten electrodes 123*a* and 123*b*. Thereafter, the lighting apparatus supplies the maximum rated power or current of the discharging lamp 12 so as to increase an amount of light emitted from the discharging lamp 12 as soon as possible. At this time, the flowing current activates the starting gas 127 filled in the discharging lamp 12 to start arc discharge of the starting gas 127.

Further, discharging lamp voltage of the discharging lamp 12 at this time increases from about 20 V, and the lighting apparatus adjusts to gradually decrease power fed to the discharging lamp 12 according to the voltage so as to adjust the amount of light emitted from the discharging lamp 12 in an overload state. At a time of control of the feeding power, a temperature in the discharging lamp 12 rapidly increases to vaporize the mercury 128, thereby starting arc discharge of a mercury gas. A temperature at a center portion of the mercury arc reaches about 4500K (Kelvins), and a higher temperature and higher pressure are generated in the arc tube 122. Accordingly, evaporation of the metallic halide 126 is started so that a metallic ion is separated from a halogen ion in the arc, resulting in emission of the metallic ion with spectrum inherent in metals.

After almost the entire metallic halide 126 is vaporized, the arc light has a final form and reaches final output, and the discharging lamp voltage of the discharging lamp 12 is saturated, resulting in stable voltage (hereinafter referred to as final discharging lamp voltage). At the time, the lighting apparatus fixes power supplied to the discharging lamp 12 to rated power so that the discharging lamp 12 can emit stable light without flickering.

Such a discharging lamp lighting apparatus is disclosed in, for example, Japanese Patent Application Nos. 4-129365 and 4-276791 which have previously been filed by the applicant.

FIG. 25 is a circuit diagram of the conventional discharging lamp lighting apparatus.

In FIG. 25, reference numeral 1 is a battery power source, and 13 is an inverter circuit connected to the battery power source 1 through a lighting switch 2. The inverter circuit 13 includes switching devices 13*a*, 13*b* which are alternately turned ON and OFF, a boosting transformer 13*c* for boosting voltage of the battery power source 1 converted into ac current by the switching devices 13*a* and 13*b* to desired voltage, and a coupling capacitor 13*d*.

Reference numeral 14 is a drive section, and 15 is an LC series resonance circuit including a choke coil 15*a*, capacitors 15*b* and 15*c*, a resistor 15*d*, and a switch 18. In this case, in order to avoid reduction of sharpness Q of resonance, a value of resistance in the resistor 15*d* is defined as a negligible value as compared to effective resistance due to the choke coil 15*a* and the capacitors 15*b*, 15*c* in resonance. Reference numeral 12 is the discharging lamp, 16 is a self-excited oscillation circuit serving as original oscillation for outputting resonance frequency, and 17 is a TTL level converting circuit.

Reference numeral 6 is voltage detecting means for detecting the voltage of the discharging lamp 12 after dielectric breakdown from a node between the capacitors 15*b* and 15*c* through the switch 18, 5 is current detecting means for detecting current in the discharging lamp 12 through a current transformer 19, and 9 is a dielectric breakdown detecting circuit to detect rush current flowing in the discharging lamp 12 during the dielectric breakdown through the current transformer 19 so as to transmit a signal indicating whether or not the dielectric breakdown occurs.

Reference numeral 70 is control means including a microcomputer or the like, for instructing ON-OFF operations of the switch 18 and for controlling frequency outputted to the inverter circuit 13 depending upon signals transmitted from the voltage detecting means 6, the current detecting means 5, and the dielectric breakdown detecting circuit 9. There is provided another means for storing the final discharging lamp voltage depending upon a signal transmitted from the voltage detecting means 6. FIG. 26 is a diagram showing a detailed periphery of the discharging lamp 12. In FIG. 26, reference numeral 21 is a discharging lamp exchange detecting switch which is automatically turned ON when the discharging lamp 12 is removed, 22 is a fix base for fixing the discharging lamp 12 including a socket, and 23 is the socket for fixing the discharging lamp.

In the apparatus, when a light switch 2 is turned ON to control flash of the discharging lamp 12, the control means 70 opens the switch 18 so as to open input from the voltage detecting means 6, and is in a waiting state until the control means 70 receives a signal from the dielectric breakdown detecting circuit 9.

On the other hand, the self-excited oscillation circuit 16 is operated to output a self-excited oscillation frequency. The oscillation frequency is resonated in the inverter circuit 13, the LC series resonance circuit 15, and the TTL level converting circuit 17. Subsequently, amplified high voltage is applied to the discharging lamp 12 to cause the dielectric breakdown between the electrodes in the discharging lamp 12. At the moment, the discharging lamp 12 is in a substantially short-circuited state so that the rush current flows in the discharging lamp 12. The rush current is detected by the dielectric breakdown detecting circuit 9 via the current transformer, and the detected signal is transmitted to the control means 70 so as to decide that the dielectric breakdown occurs.

The control means 70 receives the signal from the dielectric breakdown detecting circuit 9 to stop output from the self-excited oscillation circuit 16 to the inverter circuit 13. Instead, the control means 70 outputs a frequency to conduct rated current (ranging from 2 to 3 A) as a normal lighting signal to the inverter circuit 13 via the drive section 14. Concurrently, the control means 70 closes the switch 18 to connect an input terminal of the voltage detecting means 6 with the node between the capacitors 15*b* and 15*c*.

Subsequently, the discharging lamp 12 is turned ON by flowing current based upon the frequency to conduct the rated current (ranging from 2 to 3 A) outputted into the inverter circuit 13 via the drive section 14. Here, the current flowing in the discharging lamp 12 is compared with a predetermined value in the current detecting means 5 so as to determine whether or not the discharging lamp 12 is turned ON. If it is determined that the discharging lamp 12 is not turned ON, the above operation is repeated. Otherwise, the voltage detecting means 6 reads the voltage of the discharging lamp 12.

In this case, if the final discharging lamp voltage V is not stored in storing means of the control means 70, the final discharging lamp voltage $V_x$ is defined as the minimum rated voltage in specification of the discharging lamp 12 to set a power control pattern (for example, a pattern which is smoothly attenuated in a range from 75 to 35 W). A target current can be calculated depending upon the power and the voltage of the discharging lamp 12 detected from the voltage detecting means 6 by an expression: current= power/voltage. The frequency outputted from the control means 70 is reduced if the current flowing in the discharging lamp is smaller than the target current, and the frequency is increased if the current is larger than the target current. It is thereby possible to cause the discharging lamp voltage to come closer to the final discharging lamp voltage $V_x$ according to the smooth attenuation pattern. The frequency is varied and adjusted so as to maintain rated power (of, for example, 35 W) when the discharging lamp voltage becomes equal to or more than the final discharging lamp voltage $V_x$, resulting in performing lighting control.

Otherwise, if the final discharging lamp voltage $V_x$ is stored, the minimum rated voltage in the specification in the above control is replaced with the stored value, and the power control pattern is also varied to another pattern corresponding to new final discharging lamp voltage $V_x$. Similar lighting control is performed so as to provide power suitable for the discharging lamp voltage at this time.

The lighting control is performed as set forth above, and thereafter the lighting switch 2 is turned OFF. Then, after it is confirmed that the discharging lamp 12 is in a stable state, final discharging lamp voltage $V_x$ at that time is stored by the voltage detecting means 6 in a memory in the control means 70. Any desired time period up to a discharging lamp stable state which is experimentally defined in advance is set to decide whether or not the time period has elapsed, thereby confirming the stable state of the discharging lamp 12. It is thereby possible to prevent from storing erroneous final discharging lamp voltage $V_x$ even if the lighting switch 2 is turned OFF before the discharging lamp stable state.

The final discharging lamp voltage $V_x$ is stored for each lighting. It is thereby possible to, even if the final discharging lamp voltage $V_x$ is varied due to degradation of the discharging lamp or the like, perform the optimal lighting control in the state. In this case, the voltage detecting means 6 and the current detecting means 5 have desired sampling times.

When the discharging lamp 12 is removed, the discharging lamp exchange detecting switch 21 is turned ON, and a high level signal is inputted into the control means 70. The signal erases the final discharging lamp voltage $V_x$ stored in the control means 70. At the next lighting time, it is decided that the final discharging lamp voltage $V_x$ is not stored, and lighting control corresponding to the minimum rated voltage value is performed.

The discharging lamp lighting apparatus as described in detail above is provided with the means for storing the final discharging lamp voltage $V_x$. Thus, the lighting control can be performed by the power control pattern corresponding to the final discharging lamp voltage $V_x$ for each discharging lamp. It is thereby possible to provide the stable state more rapidly, and optimize a rise characteristic of the amount of light. Further, when the final discharging lamp voltage $V_x$ is stored, it is decided before the storing whether or not the discharging lamp 12 is in the stable state. It is thereby possible to avoid lighting control based upon erroneous final discharging lamp voltage $V_x$. In addition, the minimum rated voltage is provided to prevent the amount of light of the discharging lamp in the stable state from exceeding an amount of light at a time of the rated power, and to avoid reduction of a lifetime.

The conventional discharging lamp lighting apparatus, however, is provided as set forth above so that the following problems are generated. No final discharging lamp voltage $V_x$ is stored at an initial lighting time or at an initial lighting time after exchanging the discharging lamp. Hence, the power control is performed by using the minimum rated voltage of the discharging lamp in the specification as the control target voltage, and a rise of the amount of light becomes slower than that in case of the optimal control. Further, when the erroneous final discharging lamp voltage $V_x$ is stored due to noise and so forth, the optimal control can not be performed at the next lighting time. Thus, the rise characteristic of the amount of light is deteriorated and the lifetime is reduced. In addition, it is necessary to provide means for detecting whether or not the discharging lamp is exchanged, resulting in an expensive apparatus.

SUMMARY OF THE INVENTION

The present invention is made to overcome the problems as described above, and it is an object of the present invention to provide an inexpensive discharging lamp lighting apparatus which enables control according to variations in a discharging lamp even at an initial lighting time and at a lighting time after exchange of the discharging lamp.

It is another object of the present invention to provide a discharging lamp lighting apparatus which can prevent overpower from being fed.

It is still another object of the present invention to provide a discharging lamp lighting apparatus which can easily predict final discharging lamp voltage.

It is a further object of the present invention to provide a discharging lamp lighting apparatus which can find more correct final discharging lamp voltage.

It is a further object of the present invention to provide a discharging lamp lighting apparatus which can perform control according to the variations in the discharging lamp even when a stored value is not present.

It is a further object of the present invention to provide an inexpensive discharging lamp lighting apparatus which enables the optimal control even if the stored value is affected by noise or the like, and the discharging lamp is exchanged.

It is a further object of the present invention to provide a discharging lamp lighting apparatus which can prevent a stored value affected by the noise or the like from being used.

According to the first aspect of the present invention, for achieving the above-mentioned objects, there is provided a discharging lamp lighting apparatus including predicting means for predicting final discharging lamp voltage of a discharging lamp, characteristic selecting means for selecting a discharging lamp voltage-current corresponding characteristic depending upon the predicted value, and current control means for controlling discharging lamp current depending upon the selected discharging lamp voltage-current corresponding characteristic.

As stated above, in the discharging lamp lighting apparatus according to the first aspect of the present invention, after lighting the discharging lamp, the predicting means predicts the final discharging lamp voltage before the discharging lamp reaches a saturated and stable state. The characteristic selecting means defines the predicted value as control target voltage to select the discharging lamp voltage-current corresponding characteristic corresponding to the control target voltage. Further, the current control means controls the discharging lamp current depending upon the selected discharging lamp voltage-current corresponding characteristic.

According to the second aspect of the present invention, there is provided a discharging lamp lighting apparatus in which, until predicting means predicts final discharging lamp voltage, characteristic selecting means uses previously stored minimum rated voltage of a discharging lamp to select a discharging lamp voltage-current corresponding characteristic.

As stated above, in the discharging lamp lighting apparatus according to the second aspect of the present invention, until the predicting means predicts the final discharging lamp voltage, the previously stored minimum rated voltage of the discharging lamp is used as control target voltage. Until the prediction is completed, the characteristic selecting means selects the discharging lamp voltage-current corresponding characteristic corresponding to the minimum rated voltage from preset discharging lamp voltage-current corresponding characteristics.

According to the third aspect of the present invention, there is provided a discharging lamp lighting apparatus in which, after lighting the discharging lamp, predicting means predicts final discharging lamp voltage by selecting one of preset discharging lamp voltage characteristics depending upon discharging lamp voltages at two optionally predetermined times after the discharging lamp voltage is minimized.

As stated above, in the discharging lamp lighting apparatus according to the third aspect of the present invention, after the discharging lamp lighting, the predicting means finds the discharging lamp voltage at any desired time after the discharging lamp voltage is minimized (hereinafter referred to as prediction starting voltage) and a time varying rate of the discharging lamp voltage depending upon discharging lamp voltage after an appropriate predetermined time from the desired time, and predicts the final discharging lamp voltage by selecting one of the preset discharging lamp voltage characteristics depending upon the prediction starting voltage and the time varying rate.

According to the fourth aspect of the present invention, there is provided a discharging lamp lighting apparatus including final discharging lamp voltage storing means for storing final discharging lamp voltage of a discharging lamp.

As stated above, in the discharging lamp lighting apparatus according to the fourth aspect of the present invention, after lighting the discharging lamp, predicting means predicts the final discharging lamp voltage before the discharging lamp reaches a saturated and stable state. Further, if the discharging lamp is in the saturated and stable state when a lighting switch is turned OFF, discharging lamp voltage at this time is stored in the final discharging lamp voltage storing means.

According to the fifth aspect of the present invention, there is provided a discharging lamp lighting apparatus in which characteristic selecting means uses a stored value if the stored value of final discharging lamp voltage is present in final discharging lamp voltage storing means, otherwise, uses a predicted value if the stored value is not present so as to select a discharging lamp voltage-current corresponding characteristic.

As stated above, in the discharging lamp lighting apparatus according to the fifth aspect of the present invention, control target voltage is defined as the stored value if the stored value of the final discharging lamp voltage is present in the final discharging lamp voltage storing means, otherwise, is defined as the predicted value. The characteristic selecting means selects the discharging lamp voltage-current corresponding characteristic corresponding to the control target voltage.

According to the sixth aspect of the present invention, there is provided a discharging lamp lighting apparatus in which characteristic selecting means uses a predicted value if a difference between the predicted value of predicting means and a stored value of final discharging lamp voltage in final discharging lamp voltage storing means is equal to or more than a predetermined value, otherwise, uses the stored value if less than the predetermined value so as to select a discharging lamp voltage-current corresponding characteristic.

As stated above, in the discharging lamp lighting apparatus according to the sixth aspect of the present invention, control target voltage is defined as the predicted value if the difference between the predicted value of the predicting means and the stored value of the final discharging lamp voltage in the final discharging lamp voltage storing means is equal to or more than the predetermined value, otherwise, is defined as the stored value if less than the predetermined value. Further, the characteristic selecting means selects the discharging lamp voltage-current corresponding characteristic corresponding to the control target voltage.

According to the seventh aspect of the present invention, there is provided a discharging lamp lighting apparatus in which, until predicting means predicts final discharging lamp voltage, characteristic selecting means uses a stored value if the stored value of final discharging lamp voltage is present in final discharging lamp voltage storing means, otherwise, uses previously stored minimum rated voltage of a discharging lamp if the stored value is not present so as to select a discharging lamp voltage-current corresponding characteristic.

As stated above, in the discharging lamp lighting apparatus according to the seventh aspect of the present invention, until the predicting means predicts the final discharging lamp voltage, the characteristic selecting means defines control target voltage as the stored value if the stored value of the final discharging lamp voltage is present in the final discharging lamp voltage storing means, otherwise, uses the previously stored minimum rated voltage of the discharging lamp if the stored value is not present so as to select the discharging lamp voltage-current corresponding characteristic.

According to the eighth aspect of the present invention, there is provided a discharging lamp lighting apparatus, until predicting means predicts final discharging lamp voltage, characteristic selecting means selects a discharging lamp voltage-current corresponding characteristic by, in case a stored value of final discharging lamp voltage is present in final discharging lamp voltage storing means, using the stored value of predicted final discharging lamp voltage if a difference between the stored value of the final discharging lamp voltage and the stored value of the predicted final discharging lamp voltage in the predicted final discharging lamp voltage storing means is equal to or more than a predetermined value, otherwise, using the stored value of the final discharging lamp voltage if less than the predetermined value, or by, in case only the stored value of the predicted final discharging lamp voltage is present in the predicted final discharging lamp voltage storing means, using the stored value of the predicted final discharging lamp voltage, or by, in case both the stored values are not present, using previously stored minimum rated voltage of a discharging lamp.

As stated above, in the discharging lamp lighting apparatus according to the eighth aspect of the present invention, when the predicting means completes prediction, the predicted value is stored in the predicted final discharging lamp voltage storing means. Until the predicting means predicts the final discharging lamp voltage, in case the stored value of the final discharging lamp voltage is present in the final discharging lamp voltage storing means, control target voltage is defined as the stored value of the predicted final discharging lamp voltage if the difference between the stored value of the final discharging lamp voltage and the stored value of the predicted final discharging lamp voltage in the predicted final discharging lamp voltage storing means is equal to or more than the predetermined value. Otherwise, the control target voltage is defined as the stored value of the final discharging lamp voltage if less than the predetermined value. Further, in case only the stored value of the predicted final discharging lamp voltage is present in the predicted final discharging lamp voltage storing means, the control target voltage is defined as the stored value of the predicted final discharging lamp voltage. Alternatively, in case both the stored values are not present, the previously stored minimum rated voltage of the discharging lamp is used. The characteristic selecting means thereby selects the discharging lamp voltage-current corresponding characteristic.

The above and further objects and novel features of the invention will more fully appear from the following detailed description when the same is read in connection with the accompanying drawing. It is to be expressly understood, however, that the drawings are for purpose of illustration only and are not intended as a definition of the limits of the invention.

BRIEF DESCRIPTION OF THE DRAWINGS

FIG. 17 is a flowchart diagram illustrating a lighting control operation according to the embodiment 3 of the present invention;

FIG. 20 is a flowchart diagram illustrating a lighting control operation according to the embodiment 4;

FIG. 22 is a flowchart diagram illustrating a lighting/control operation according to the embodiment 5 of the present invention;

DETAILED DESCRIPTION OF THE PREFERRED EMBODIMENTS

Preferred embodiments of the invention will now be described in detail referring to the accompanying drawings.

EMBODIMENT 1

A description will now be given of the embodiment 1 of the present invention with reference to FIG. 1.

Figure 1:
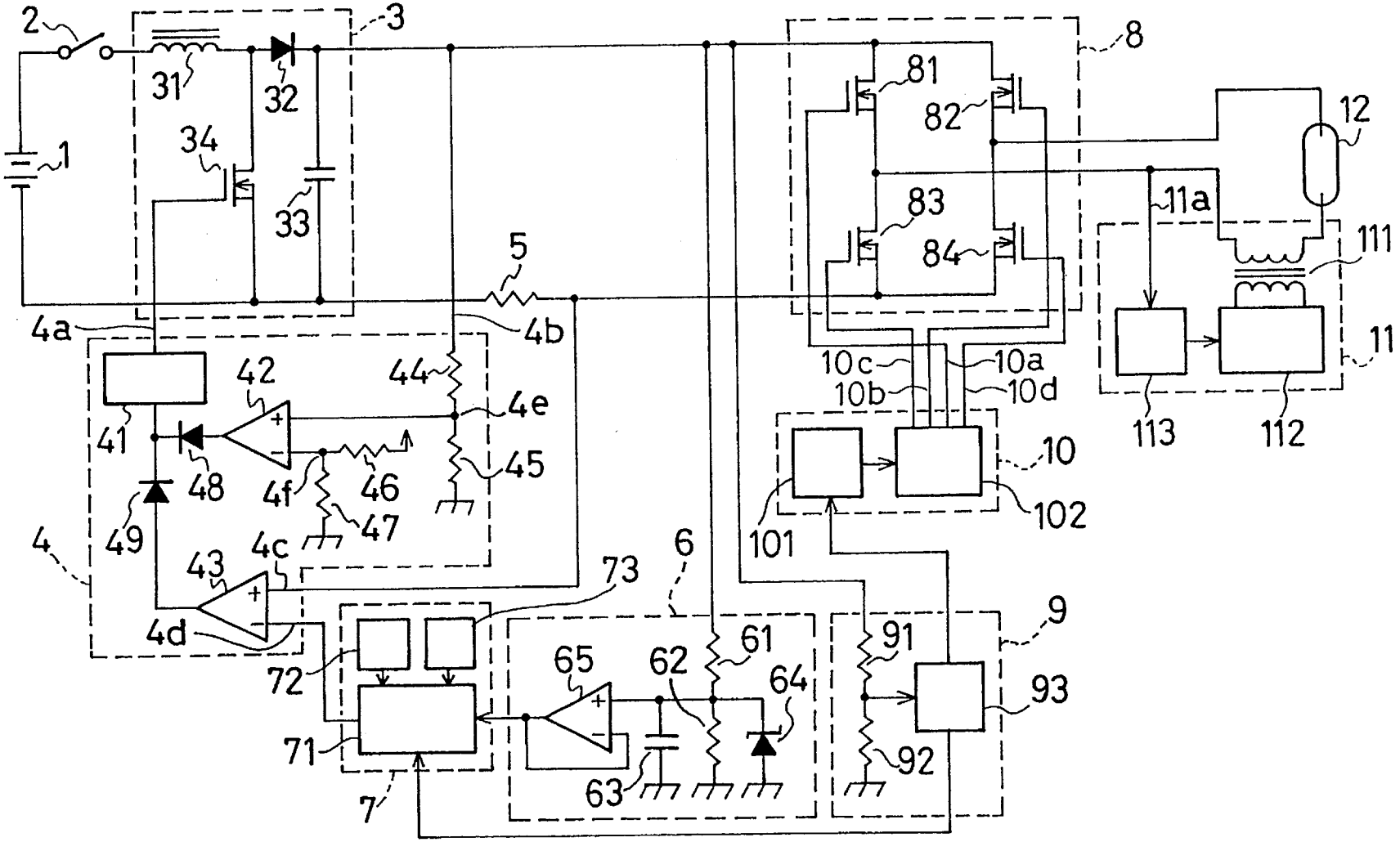
FIG. 1 is a block diagram showing a discharging lamp lighting apparatus according to the embodiment 1 of the present invention.

In FIG. 1, reference numeral 1 means a DC power source, 2 is a lighting switch, and 3 is DC boosting means having a boosting chopper structure. The DC boosting means 3 includes a coil 31, a diode 32, a capacitor 33, and a switching device 34.

The DC power source 1 is connected to one terminal of the coil 31 serving as an input terminal of the DC boosting means 3 via the lighting switch 2. The other terminal of the coil 31 is connected to a drain terminal of the switching device 34 and an anode terminal of the diode 32. A cathode terminal of the diode 32 is connected to one terminal of the capacitor 33 to serve as output of the DC boosting means 3, and the other terminal of the capacitor 33 is connected together with a source terminal of the switching device 34 to GND of the DC power source 1.

Reference numeral 4 is boosting control means including a PWM control section 41, error amplifiers 42 and 43, resistors 44 to 47, and diodes 48 and 49. An output terminal 4*a* of the PWM control section 41 is connected to a gate terminal of the switching device 34 of the DC boosting means 3, and an input terminal 4*b* of the resistor 44 is connected to the output of the DC boosting means 3. Further, a non-inverting input terminal 4*c* of the error amplifier 43 is connected to the other terminal of current detecting means 5 whose one terminal is grounded to the GND. An inverting input terminal 4*d* of the,error amplifier 43 is connected to output of discharging lamp control means 7 including current command means.

The resistors 44 and 45 are connected in series between the terminal 4*b* of the boosting control means 4 and the GND, and a node 4*e* of the resistors 44 and 45 is connected to a non-inverting input terminal of the error amplifier 42. Further, the resistors 46 and 47 are connected in series between reference voltage (of, for example, 5 V) and the GND, and a node 4*f* of the resistors 46 and 47 is connected to an inverting input terminal of the error amplifier 42.

Output from the error amplifiers 42 and 43 are wired OR via the diodes 48 and 49 to be inputted into the PWM control section 41. In this case, the PWM control section 41 expands on-duty of a signal outputted to the switching device 34 so as to increase the degree of boosting of the DC boosting means 3 when an output level of the error amplifier 42 or 43 is low. Otherwise, when the output level of the error amplifier 42 or 43 is high, the PWM control section 41 narrows the on-duty of the switching device 34 so as to decrease the degree of boosting.

As described above, the PWM control section 41 is connected to the error amplifiers 42 and 43 which are wired OR so that priority is given to any one of the error amplifiers having a higher output level, and the output from the error amplifier having the priority is inputted into the PWM control section 41. Further, the DC boosting means 3, the boosting control means 4, and the current detecting means 5 are provided to form current control means.

Reference numeral 6 is voltage detecting means including resistors 61 and 62, a capacitor 63, a Zener diode 64, and an operational amplifier 65. One terminal of the resistor 61 serves as an input terminal of the voltage detecting means 6, and is connected to the output terminal of the DC boosting means 3. The other terminal thereof is grounded to the GND via the resistor 62, and is connected to a cathode of one terminal of the capacitor 63 and the Zener diode 64 to be connected to anon-inverting input terminal of the operational amplifier 65. The other terminals of the capacitor 63 and the Zener diode 64 are grounded to the GND, respectively. The Zener diode 64 is interposed for main purpose of protection, that is, so as not to feed overvoltage to the non-inverting input of the operational amplifier 65. Further, an inverting input terminal of the operational amplifier 65 is connected to output of the operational amplifier 65 so as to serve as output of the voltage detecting means 6.

The discharging lamp control means 7 has processing means 71 including characteristic selecting means, a command discharging lamp current table 72 in which current command data is stored, and predicting means 73. The processing means 71 includes a microcomputer with built-in A/D and D/A converters, the command discharging lamp current table 72 includes a memory such as ROM, and the predicting means 73 includes a microcomputer. The discharging lamp control means 7 commands power fed to the discharging lamp 12, that is, commands current depending upon input from the voltage detecting means 6 so as to output the command signal to the input terminal 4*d* of the boosting control means 4.

Here, an output voltage value of the discharging lamp control means 7 indicates a command discharging lamp current value which is identical to a current value indicated by voltage generated in the current detecting means 5 to be inputted into the input terminal 4*c* of the boosting control means 4. For example, if the current is 1 A when the voltage generated in the current detecting means 5 is 1 V, the output voltage value of the discharging lamp control means 7, that is, 1 V also indicates the command discharging lamp current of 1 A.

Reference numeral 8 is inverter means having a full-bridge structure including switching devices 81 to 84. Drain terminals of the switching devices 81 and 82 are connected to the output terminal of the DC boosting means 3, and source terminals thereof are respectively connected to drain terminals of the switching devices 83 and 84. Further, the drain terminals of the switching devices 83 and 84 are grounded to the GND via the current detecting means 5.

Reference numeral 9 is starting discharge detecting means including resistors 91 and 92 which are connected in series between output of the DC boosting means 3 and the GND so as to input divided voltage into a comparator 93. The comparator 93 detects a trailing edge of the divided voltage to discriminate by the detected edge that starting discharge is successfully performed, and transmits a signal to a timer circuit 101 and the discharging lamp control means 7.

Reference numeral 10 is driver means including the timer circuit 101 and a drive circuit 102, and the driver means 10 further includes output terminals 10*a* to 10*d* respectively connected to gates of the respective switching devices to turn ON and OFF the switching devices 81 to 84 forming the inverter means 8. To the terminals 10*a* to 10*d*, the drive circuit 102 outputs signals to make the switching devices 81 and 84 in phase and the switching devices 82 and 83 in phase, and make the switching devices 81 and 82 in opposite phase at a constant frequency. Further, the signal has a so-called dead time, that is, a period for which the combinations of the switching devices 81 and 84, and of the switching devices 82 and 83 are not concurrently turned ON. The timer circuit 101 measures an elapse of time after a signal is inputted from the comparator 93 into the timer circuit 101.

Reference numeral 11 is starting discharge means including a transformer 111, high voltage generating means 112, and a time constant circuit 113. A terminal on the primary side of the transformer 111 is connected to the high voltage generating means 112, and one terminal on the secondary side of the transformer 111 is connected to the source terminal of the switching device 81 forming the inverter means 8 to be connected to the high voltage generating means 112 via the time constant circuit 113. The other terminal on the secondary side of the transformer 111 is connected to one terminal of the discharging lamp 12, and the other terminal of the discharging lamp 12 is connected to the source terminal of the switching device 82 forming the inverter means 8.

In FIG. 1 illustrating the embodiment 1, the DC boosting means 3 and the inverter means 8 form feeding means for feeding power to the discharging lamp 12 to light the discharging lamp.

A description will now be given of the operation.

In FIG. 1, when the lighting switch 2 is turned ON, the boosting control means 4 is started to operate so as to boost voltage of the dc power source 1 by turning ON and OFF the switching device 34 of the DC boosting means 3. During an ON period of the switching device 34, there is established a loop including the DC power source 1, the coil 31, and the switching device 34. Current flows from the DC power source 1 into the coil 31 via the loop, resulting in accumulation of electromagnetic energy in the coil 31. Subsequently, during an OFF period of the switching device 34, there is established another loop including the coil 31, the diode 32, and the capacitor 33. Thus, the electromagnetic energy accumulated in the coil 31 for the ON period of the switching device 34 is discharged into the capacitor 33 via the diode 32, and is converted into electrostatic energy to be accumulated in the capacitor 33. Thereby, voltage is developed across the capacitor 33 after adding voltage corresponding to the accumulated energy to the voltage of the DC power source 1.

The operation of the switching device 34 is repeated at a frequency f while varying on/off-duty so as to gradually boost the voltage of the capacitor 33, that is, the output of the DC boosting means 3. Here, it is assumed that the output of the DC boosting means 3 is $V_a$. The on/off-duty of the switching device 34 is varied according to input from the terminals 4*b*, 4*c*, and 4*d* of the boosting control means 4.

In the boosting control means 4, the error amplifier 42 amplifies a difference between fixed voltage $V_f$ (inverting input) at the point 4*f* which is obtained by dividing the reference power source by the resistors 46 and 47, and voltage $V_e$ (non-inverting input) at the point 4*e* which is obtained by dividing the output $V_a$ of the DC boosting means 3 by the resistors 44 and 45. Here, the fixed voltage $V_f$ is set such that the voltage $V_e$ at the point 4*e* is equal to voltage for $V_a$=400 V (hereinafter referred to as a predetermined value 1). At a time the lighting switch 2 is turned ON, the output $V_a$ of the DC boosting means 3 is lower than the predetermined value 1, and the output of the error amplifier 42 is at a lower level. Consequently, the PWM control section 41 expands the on-duty of a gate signal output to the switching device 34 so as to increase the degree of boosting of the output $V_a$ of the DC boosting means 3, and further narrows the on-duty to decrease the degree of boosting as $V_a$ rises to be closer to the predetermined value 1. Further, at a time of reaching the predetermined value 1 ($V_f$=$V_e$), the PWM control section 41 maintains the voltage.

It is assumed that a time period from an ON time of the lighting switch 2 to the time to reach the predetermined value 1 is defined as $t_a$. At the time, since no current is present in the current detecting means 5 (i.e., voltage $V_C$ at the point 4*c* being zero), the error amplifier 43 has a lower level output than that of the error amplifier 42. Therefore, the output of the error amplifier 43 is not input into the PWM control section 41, and is irrelevant to the boosting operation.

Concurrently with the above boosting operation, the drive circuit 102 holds an ON state of the switching devices 81 and 84 of the inverter means 8, and holds an OFF state of the switching devices 82 and 83. Accordingly, the output $V_a$ (DC voltage) of the DC boosting means 3 is directly applied to the discharging lamp 12.

The output $V_a$ of the DC boosting means 3 is inputted into the time constant circuit 113 of the starting discharge means 11 via a node 11*a*. When output of the time constant circuit 113 reaches a predetermined value 2, the high voltage generating means 112 outputs impulse voltage to the transformer 111 so that a high voltage pulse is applied to the discharging lamp 12 to cause the starting discharge. A time $t_b$ required for the output of the time constant circuit 113 reaching the predetermined value 2, and the time $t_a$ required for the output $V_a$ of the DC boosting means 3 reaching the predetermined value 1 can be expressed as $t_b \geqq t_a$.

Figure 2:
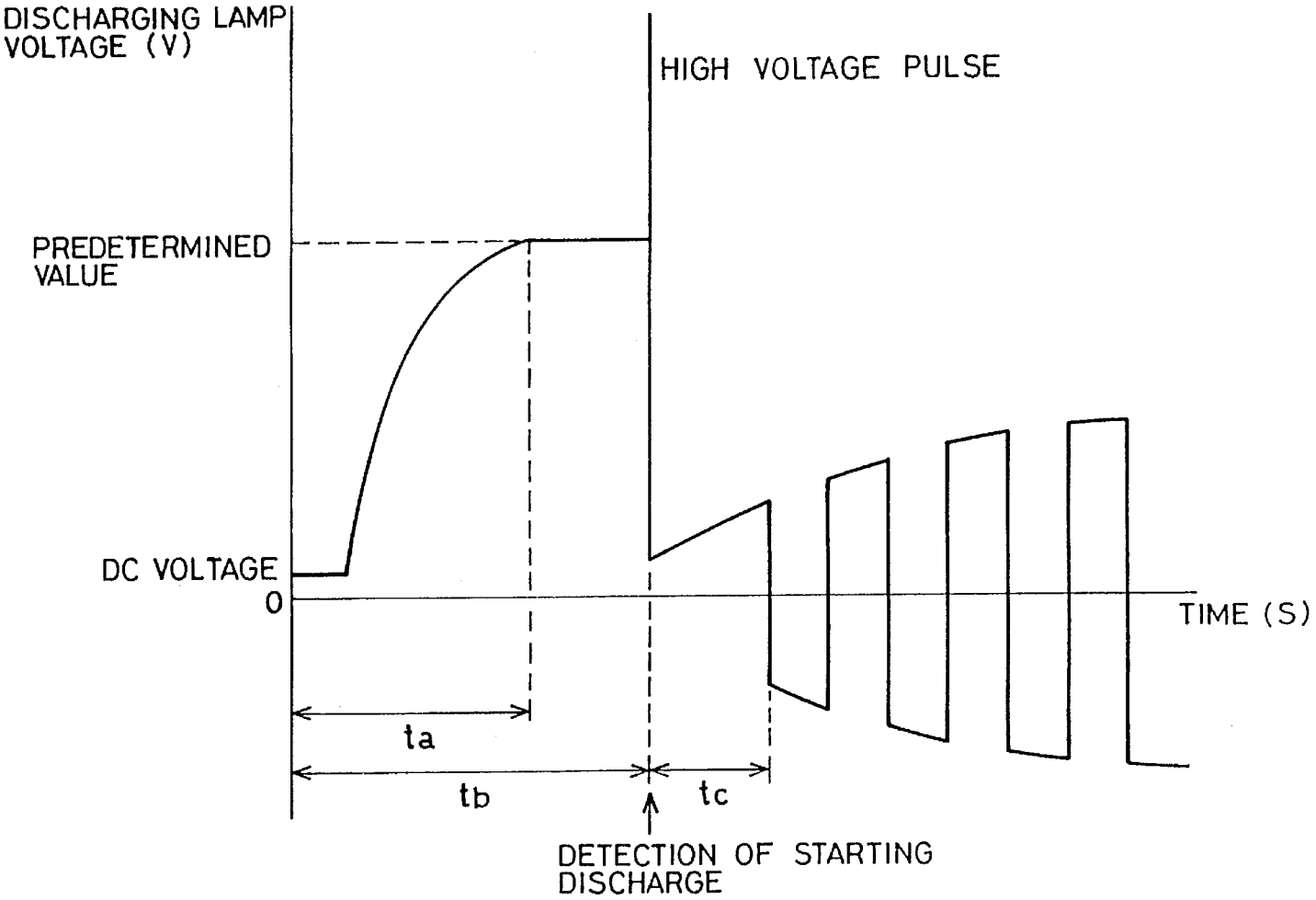
FIG. 2 is a waveform diagram showing a variation in voltage across a discharging lamp at a starting discharge time in the embodiment 1.

When the current flows in the discharging lamp 12 to start the starting discharge, a load of the DC boosting means 3 (impedance of the discharging lamp 12) is varied, that is, a no load state is changed into a heavy load state, resulting in rapid drop of the output $V_a$ of the DC boosting means 3. The rapid voltage drop is detected by the starting discharge detecting means 9, and is transmitted to the timer circuit 101 and the discharging lamp control means 7 so that the timer means 101 counts a predetermined time $t_C$. At a time the timer circuit 101 has counted the predetermined time $t_C$, the drive circuit 102 transmits signals having the dead time of about several microseconds at frequency $f_2$ (of, for example, 400 Hz) and a duty ratio of about 50% in opposite phase in order to alternately turn ON and OFF the switching devices 81 and 84, and the switching devices 82 and 83. FIG. 2 shows a variation in voltage across the discharging lamp 12 during the starting discharge.

However, rectangular wave ac voltage having a zero-peak which is substantially equal to the voltage $V_a$ is applied to the discharging lamp 12 while an ON loss in the discharging lamp 12 is generated due to the switching devices 81 to 84. Conversely, the voltage $V_a$ is substantially equal to the discharging lamp voltage $V_1$ of the discharging lamp 12 ($V_1 \approx V_a$).

On the other hand, the voltage detecting means 6 transmits the discharging lamp voltage $V_1$ obtained by dividing voltage by the resistors 61 and 62 to the discharging lamp control means 7 via the operational amplifier (buffer) 65. The capacitor 63 is provided so as to absorb a switching noise of the DC boosting means 3 superimposed on the lamp voltage $V_1$.

Figure 3:
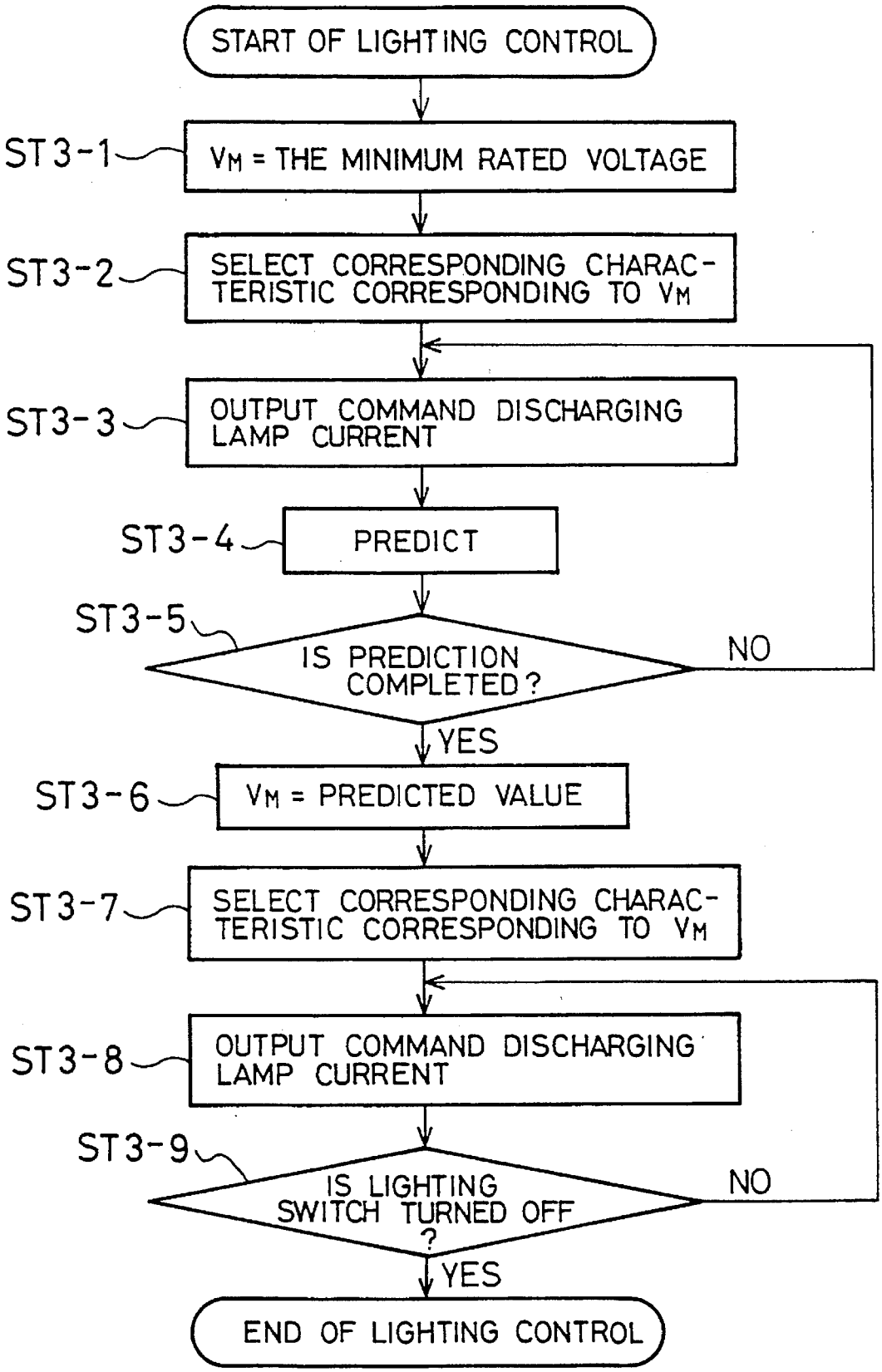
FIG. 3 is a flowchart diagram illustrating a lighting control operation in the embodiment 1.

A description will now be given of a later method of controlling the discharging lamp control means 7 with reference to a flowchart shown in FIG. 3.

In the discharging lamp control means 7, when the voltage detecting means 6 transmits the discharging lamp voltage $V_1$, in ST3-1, the processing means 71 defines control target voltage $V_M$ as previously stored minimum rated voltage in specification of the discharging lamp 12. Subsequently, in ST3-2, a corresponding characteristic corresponding to the control target voltage $V_M$ is selected from discharging lamp voltage-current corresponding characteristics which are preset in the command discharging lamp current table 72. In ST3-3, according to the discharging lamp voltage $V_1$ transmitted from the voltage detecting means 6, the discharging lamp control means 7 reads command discharging lamp current $I_S$ applied to the discharging lamp 12 depending upon the corresponding characteristic selected in ST3-2 so as to output voltage corresponding to the command signal to the error amplifier 43.

Next, in ST3-4, the predicting means 73 starts to predict final discharging lamp voltage. In ST3-5, the processing means 71 decides whether or not the predicting means 73 completes the prediction of the final discharging lamp voltage. The operation returns to ST3-3 so as to perform control according to the corresponding characteristic selected in ST3-2 until the prediction is completed. After completion of the prediction, in ST3-6, the control target voltage $V_M$ is replaced with the final discharging lamp voltage predicted by the predicting means 73 depending upon the minimum rated voltage in the specification of the discharging lamp 12 set in ST3-1. In ST3-7, a discharging lamp voltage-current corresponding characteristic corresponding to a new control target voltage $V_M$ is selected from the command discharging lamp current table 72. In ST3-8, according to the discharging lamp voltage $V_1$ transmitted from the voltage detecting means 6, the command discharging lamp current $I_S$ applied to the discharging lamp 12 is read from the new corresponding characteristic selected in ST3-7 so as to output voltage corresponding to the command signal to the error amplifier 43.

In ST3-9, it is decided whether or not the lighting switch 2 is turned OFF, and the discharging lamp control means 7 outputs the voltage corresponding to the command signal to the error amplifier 43 until the lighting switch 2 is turned OFF.

In contrast with this, discharging lamp current $I_1$ flowing in the discharging lamp 12 in actuality is transformed by the current detecting means 5 to be input into the non-inverting input terminal of the error amplifier 43. Further, the voltage of the current $I_1$ is compared with voltage corresponding to the command discharging lamp current $I_S$ which is commanded by the discharging lamp control means 7 and is inputted into the inverting input terminal. At this time, since the error amplifier 43 has a larger output than that of the error amplifier 42, the on-duty of the switching device 34 is controlled by the PWM control section 41 according to the output of the error amplifier 43 in later steps (i.e., after the starting discharge).

In case the current detecting means 5 has a larger output than that of the discharging lamp control means 7 (i.e., the discharging lamp current $I_1$ flowing in actuality being larger than the command discharging lamp current $I_S$), the error amplifier 43 outputs a high level signal. Thereby, the PWM control section 41 narrows the on-duty of the switching device 34 to reduce output voltage of the DC boosting means 3 so as to decrease current flowing in the discharging lamp 12.

Otherwise, in case the current detecting means 5 has a smaller output than that of the discharging lamp control means 7 (i.e., the discharging lamp current $I_1$ flowing in actuality being smaller than the command discharging lamp current $I_S$), the error amplifier 43 outputs a low level signal. Thus, the PWM control section 41 expands the on-duty of the switching device 34 to increase the output voltage of the DC boosting means 3 so as to increase current flowing in the discharging lamp 12. The boosting control means 4 is operated to repeat the above operation such that the discharging lamp current $I_1$ flowing in actuality becomes equal to the command discharging lamp current $I_S$. This feedback system causes the discharging lamp 12 to rapidly reach a rated amount of light.

Figure 4:
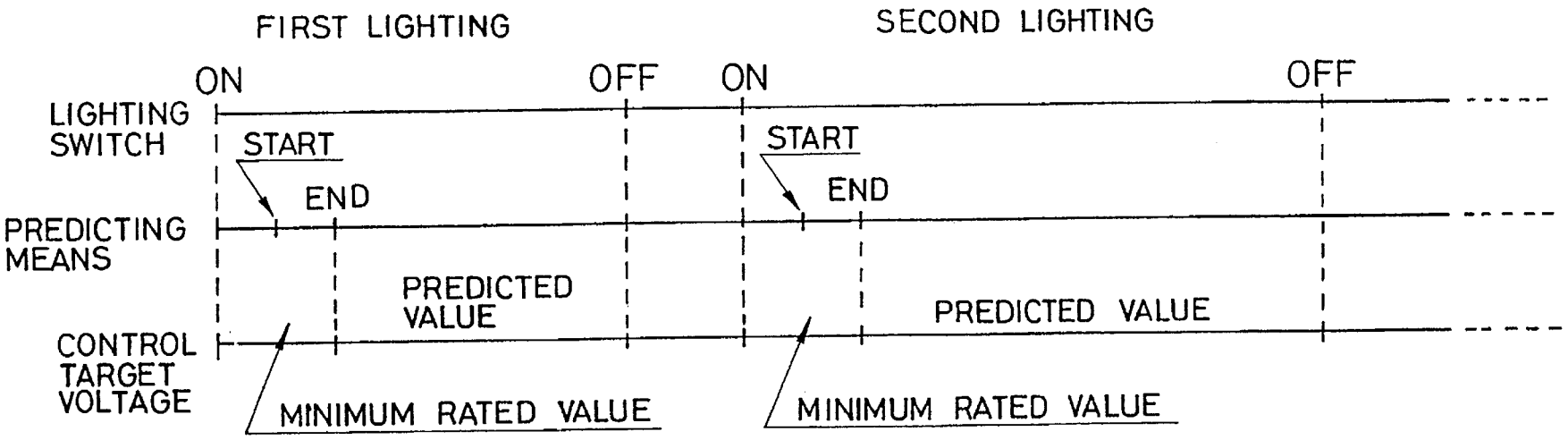
FIG. 4 is a timing diagram illustrating a control operation of discharging lamp control means according to the embodiment 1.

FIG. 4 shows one illustrative control of the discharging control means 7. When the lighting switch is turned ON in the first lighting, the control target voltage is defined as the previously stored minimum rated value of the discharging lamp, and the corresponding characteristic corresponding to the control target voltage is selected to output the command discharging lamp current $I_S$. On the other hand, the predicting means 73 is started to predict the final discharging lamp voltage, and the control target voltage is replaced with a predicted value when the prediction is completed. Hence, a new corresponding characteristic corresponding to the predicted value is selected to output the command discharging lamp current $I_S$ until the lighting switch is turned OFF. Similar control is performed in the second lighting or later.

A detailed description will now be given of the discharging lamp voltage-current corresponding characteristics which are preset in the command discharging lamp current table 72 of the discharging control means 7 by way of 35 W metal halide lamp as an example of the discharging lamp 12.

Figure 5:
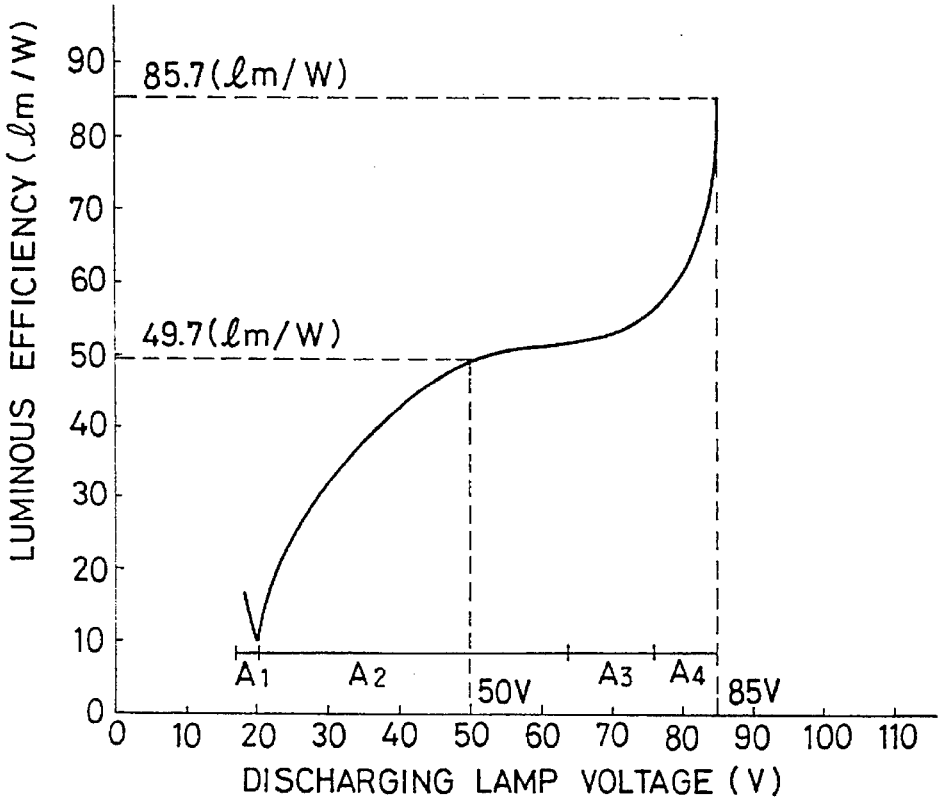
FIG. 5 is a diagram showing a relationship between discharging lamp voltage and luminous efficiency in the discharging lamp according to the embodiment 1.

FIG. 5 is a diagram showing a relationship between the discharging lamp voltage and luminous efficiency in the discharging lamp 12. In FIG. 5, the transverse axis defines the discharging lamp voltage, and the ordinate axis defines luminous flux emitted from the discharging lamp 12 per 1 Watt, that is, the luminous efficiency (1 m/W). The diagram showing the relationship between the discharging lamp voltage-luminous efficiency in FIG. 5 indicates the following:

For a period $A_1$ having low discharging lamp voltage immediately after the discharging lamp 12 begins the starting discharge, a starting gas (for example, a xenon gas) causes main emission, and the luminous efficiency at this time is relatively low.

Thereafter, for a period $A_2$ for which the discharging lamp voltage rises up to about 60 V, a temperature rise in an arc tube promotes ionization of mercury to increase mercury vapor pressure, resulting in a rise of the lamp voltage. The mercury causes almost the entire emission at this time so that the luminous efficiency also more rises as the mercury vapor pressure more increases.

For the next period $A_3$ for which the luminous efficiency is substantially constant even if the discharging lamp voltage rises, there is a state where almost the entire mercury contributing to determination of the discharging lamp voltage is vaporized. However, since the emission is still dependent upon the mercury, the luminous efficiency is hardly varied.

Further, for a period $A_4$ for which the luminous efficiency largely rises while the discharging lamp voltage has a relatively small variation, evaporation and ionization of a metallic halide are promoted and emission of metals is activated to rapidly increase the luminous efficiency. The rise of the luminous efficiency stops at a point where the discharging lamp voltage becomes a final value. A slight rise of the lamp voltage for the period $A_4$ is caused by vapor pressure of the metallic halide.

As discussed above, there is a close relationship between the discharging lamp voltage and the luminous efficiency of the discharging lamp 12, and an amount of emission [1 m] from the discharging lamp 12 can be found by an expression: luminous efficiency [1 m/W]×power [W] It is thereby possible to stabilize the amount of emission by setting power which is fed for any desired discharging lamp voltage while taking into account the luminous efficiency.

For example, during lighting at the rated power (of 35 W), the discharging lamp voltage is stabilized at the final discharging lamp voltage of 85.0 [V], and the luminous efficiency at this time is 85.7 [1 m/W] so that the luminous flux becomes 3000 [1 m] during rated lighting, that is, at a time of outputting 100% amount of emission. Hence, since the luminous efficiency is 49.7 [1 m/W] when the discharging lamp voltage is in the course of the rise, for example, the voltage is 50.0 [V], it is possible to provide, like the amount of emission at the time of feeding the rated power, the luminous flux of 3000 [1 m] by setting the feeding power of 60.4 W (3000 [1 m]/49.7 [1 m/W]=60.4 W).

Figure 6:
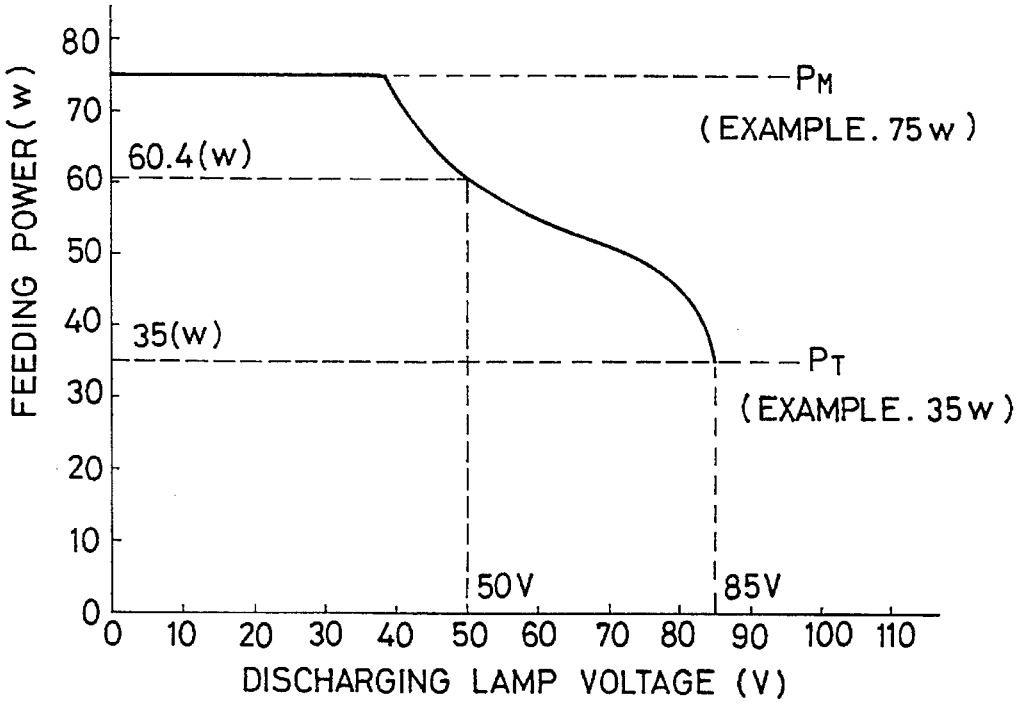
FIG. 6 is a diagram showing a discharging lamp voltage-feeding voltage corresponding characteristic in the discharging lamp according to the embodiment 1.

In view of the foregoing, FIG. 6 shows a discharging lamp voltage-feeding power corresponding characteristic which is found to provide a constant amount of emission of the discharging lamp 12. The transverse axis defines the discharging lamp voltage [V], and the ordinate axis defines discharging lamp power [W] which is fed to the discharging lamp for any desired discharging lamp voltage. In this case, since the maximum rated power $P_M$ which can be fed to the discharging lamp 12 is restricted to, for example, 75 W, FIG. 6 defines the discharging lamp voltage-feeding power corresponding characteristic in a range not to exceed the maximum rated power. In addition, PT means the rated power of the discharging lamp 12.

Figure 7:
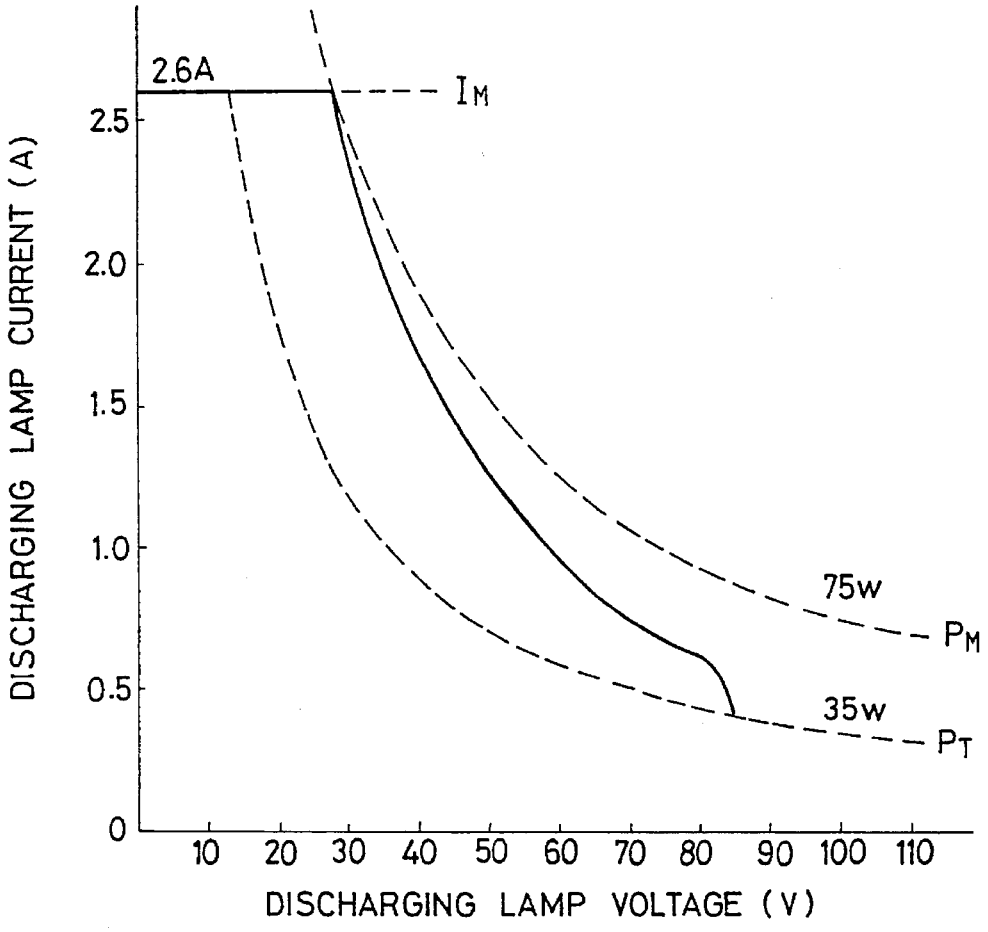
FIG. 7 is a diagram showing a discharging lamp voltage-current corresponding characteristic of the discharging lamp in the embodiment 1.

FIG. 7 shows a discharging lamp voltage-current corresponding characteristic which is found depending upon the discharging lamp voltage-feeding power corresponding characteristic. The transverse axis defines the discharging lamp voltage [V], and the ordinate axis defines discharging lamp current [A] fed to the discharging lamp 12 for any desired discharging lamp voltage. However, the maximum rated current $I_M$ which can be applied to the discharging lamp 12 is also restricted to, for example, 2.6 A. Therefore, FIG. 7 defines the discharging lamp voltage-current corresponding characteristic in a range not to exceed the maximum rated current.

Figure 8:
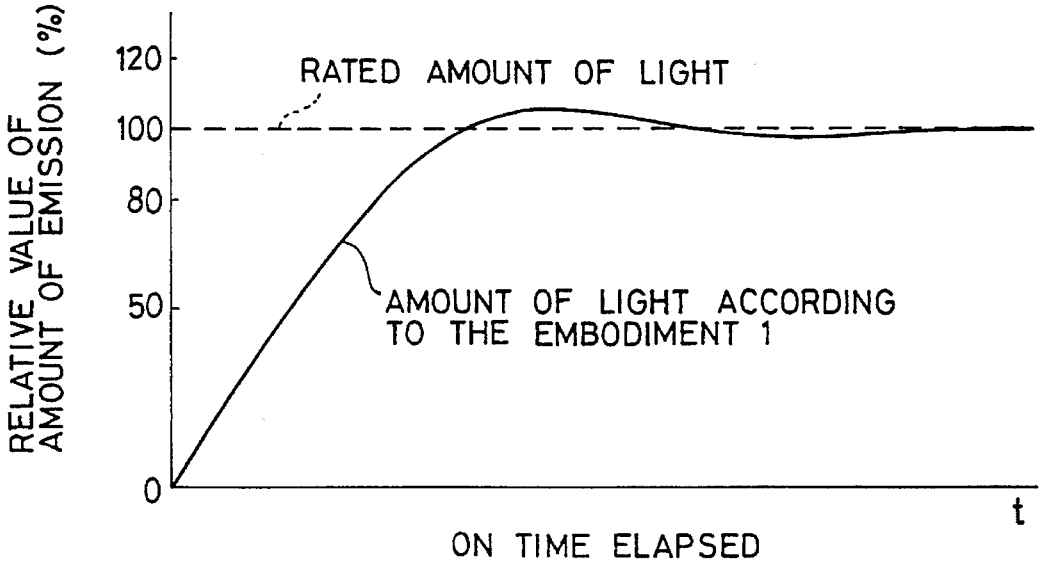
FIG. 8 is a diagram showing a light rising characteristic of the discharging lamp according to the embodiment 1.

The preset corresponding characteristics are employed to perform the feedback control, resulting in a light rising characteristic of the discharging lamp 12 shown in FIG. 8. While slight overshoot, slight undershoot and the like are caused due to the restriction of the maximum rated power and the maximum rated current, it is possible to substantially step by step and rapidly lead the amount of emission (i.e., radiant power output) of the discharging lamp to 100% amount of light (i.e., the rated amount of light).

As set forth above, the discharging lamp voltage and the feeding power are found by the relationship between the discharging lamp voltage and the luminous efficiency, and the relationship between the discharging lamp voltage and the discharging lamp current is preset as the discharging lamp voltage-current corresponding characteristic, resulting in an ideal amount of emission. In this case, however, there is generated one drawback in that the relationship between the discharging lamp voltage and the luminous efficiency is varied depending upon quality and an operating time of the discharging lamp 12. Hence, it is necessary to absorb the variation in the discharging lamp 12 in order to step by step lead the amount of emission even if any type of discharging lamp is mounted, and in the present invention, attention is given to the final discharging lamp voltage of the discharging lamp.

Figure 9:
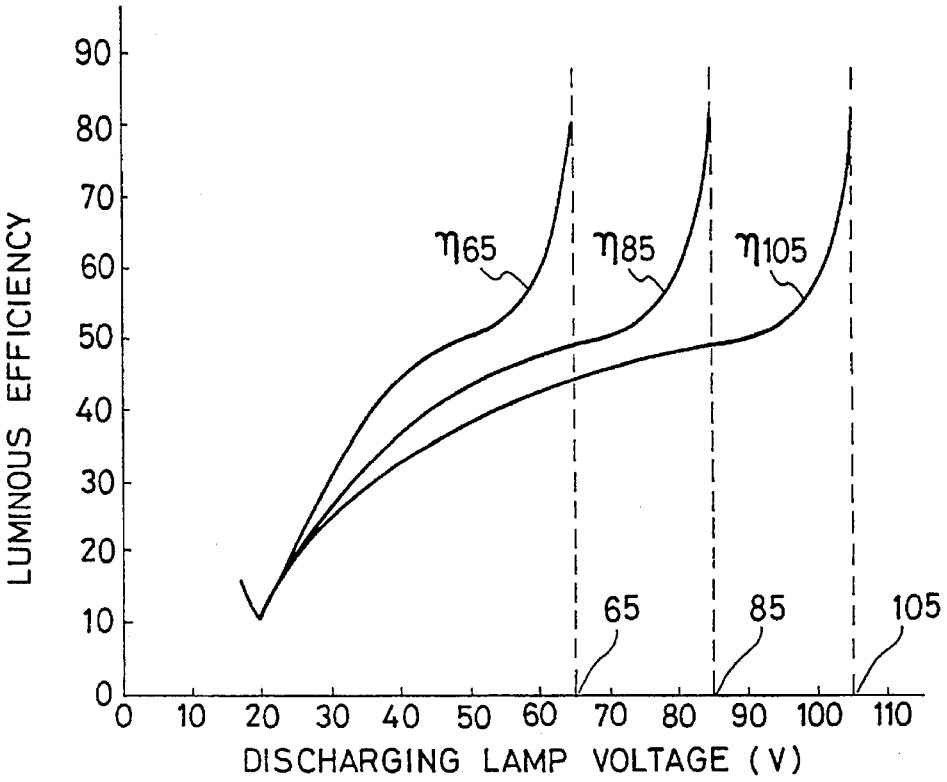
FIG. 9 is a diagram showing relationships between the discharging lamp voltage and the luminous efficiency in various discharging lamps according to the embodiment 1.

FIG. 9 shows relationships between the discharging lamp voltage and the luminous efficiency in various discharging lamps 12. The final discharging lamp voltage of the discharging lamp 12 is not constant due to the variation in the quality or the operating time of each discharging lamp. Consequently, there are various luminous efficiencies for any desired discharging lamp voltage. For example, the variation is caused as shown by luminous efficiency curves $\eta_{65}$ (indicating the final discharging lamp voltage of 65 V), $\eta_{85}$ (indicating the final discharging lamp voltage of 85 V), and $\eta_{105}$ (indicating the final discharging lamp voltage of 105 V) in FIG. 9. Therefore, in case only one discharging lamp voltage-feeding power corresponding characteristic can be found by the luminous efficiency, it is impossible to absorb a difference in the luminous efficiency to the discharging lamp voltage. It is thereby impossible to feed the optimal power to the discharging lamp, and it is difficult to realize a rapid rise of amount of light.

Figure 10:
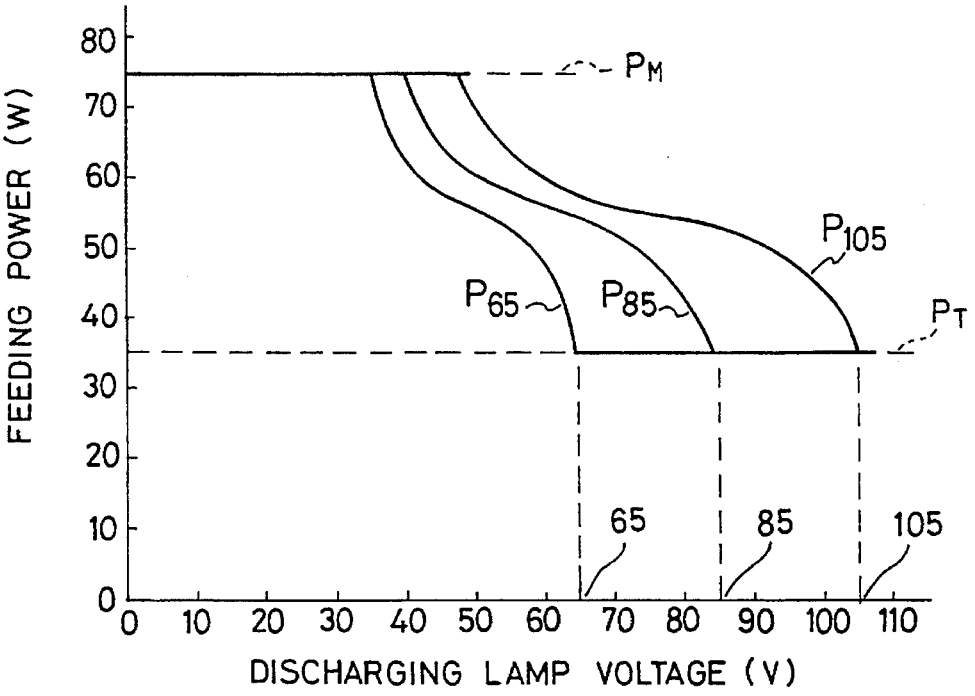
FIG. 10 is a diagram showing discharging lamp voltage-feeding power corresponding characteristics in the various discharging lamps according to the embodiment 1.

FIG. 10 shows discharging lamp voltage-feeding power corresponding characteristics which are described according to the luminous efficiency curves $\eta_{65}$, $\eta_{85}$, and $\eta_{105}$ in FIG. 9 so as to absorb the above variation in the discharging lamp. A feeding power curve $P_{65}$ in FIG. 10 is defined on the basis of the luminous efficiency curve $\eta_{65}$, and $P_{85}$ and $P_{105}$ are similarly defined on the basis of $\eta_{85}$ and $\eta_{105}$, respectively.

Figure 11:
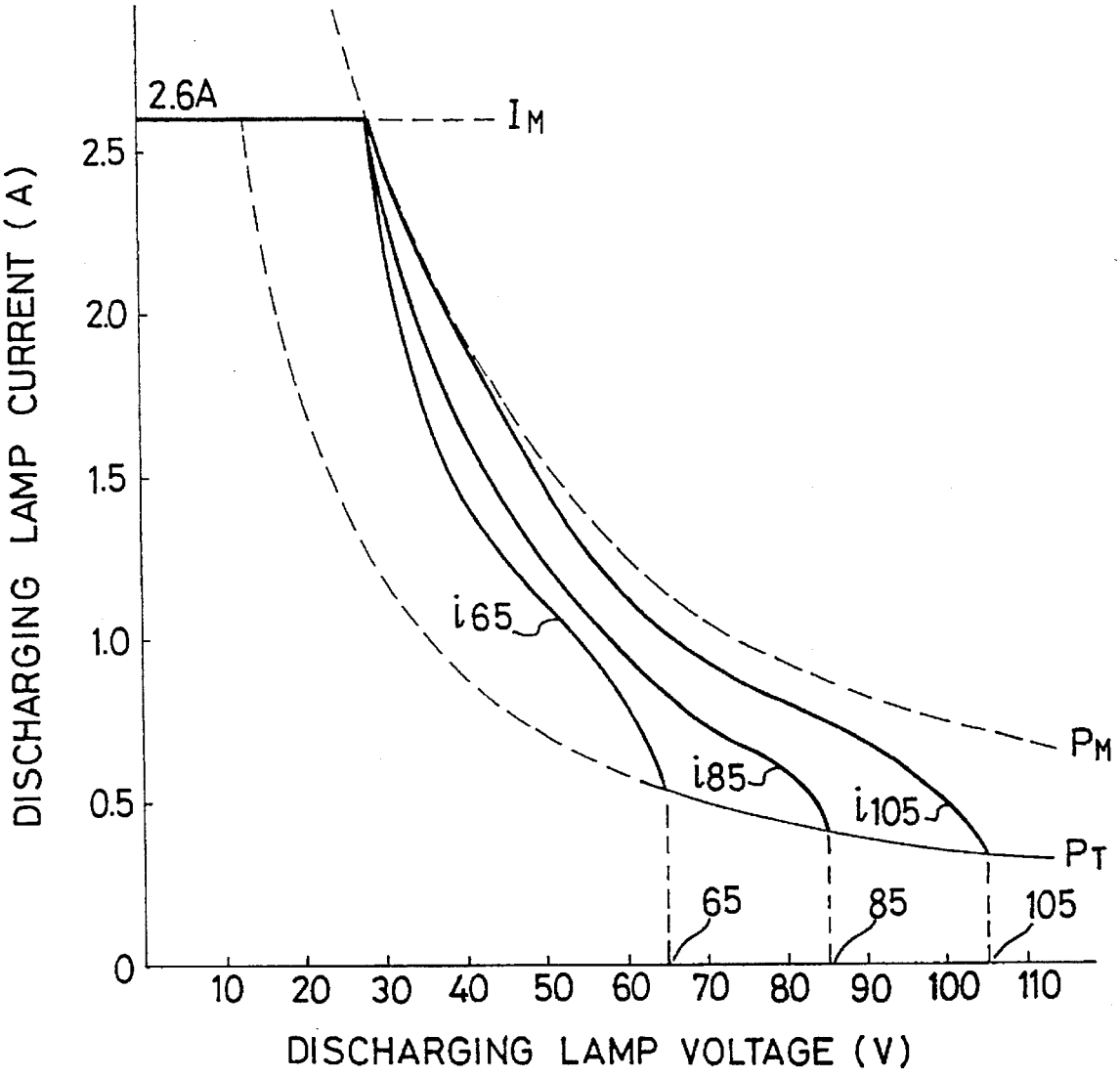
FIG. 11 is a diagram showing discharging lamp voltage-current corresponding characteristics in the various discharging lamps according to the embodiment 1.

FIG. 11 shows discharging lamp voltage-current corresponding characteristics which are described according to the feeding power curves $P_{65}$, $P_{85}$ and $P_{105}$. In FIG. 11, a discharging lamp current curve $i_{65}$ is defined on the basis of the feeding power curve $P_{65}$, and $i_{85}$ and $i_{105}$ are similarly defined on the basis of $P_{85}$ and $P_{105}$, respectively. In case the final discharging lamp voltage is more than or equal to 65 V and is less than 85 V, current is applied to the discharging lamp 12 according to the discharging lamp current curve $i_{65}$. Further, the current applied to the discharging lamp 12 is controlled according to the discharging lamp current curve $P_T$ at the time of the rated power after the discharging lamp voltage exceeds 65 V. Otherwise, in case the final discharging lamp voltage is more than or equal to 85 V and is less than 105 V, the current is applied according to the curve $i_{85}$. If equal to or more than 105 V, the current is applied according to the curve $i_{105}$.

As in the case of the final discharging lamp voltage of 65

V or more and less than 85 V, after the discharging lamp voltage exceeds voltage at lower limits of the respective discharging lamp current curves, the current applied to the discharging lamp 12 is controlled according to the discharging lamp current curve PT at the time of the rated power. It is thereby possible to feed appropriate power to the discharging lamp 12 according to the variations in the respective discharging lamps.

The discharging lamp voltage-current corresponding characteristics for three kinds of final discharging lamp voltages have been discussed in the embodiment. However, it must be noted that the present invention should not be limited to this, and three or more kinds of final discharging lamp voltages may be employed. As the number of the discharging lamp voltage-current corresponding characteristic more increases, it is possible to feed more appropriate power to the discharging lamp according to the variations in the quality or the operating time of the discharging lamp.

A description will now be given of a method of the predicting means 73 of predicting the final discharging lamp voltage.

Figure 12:
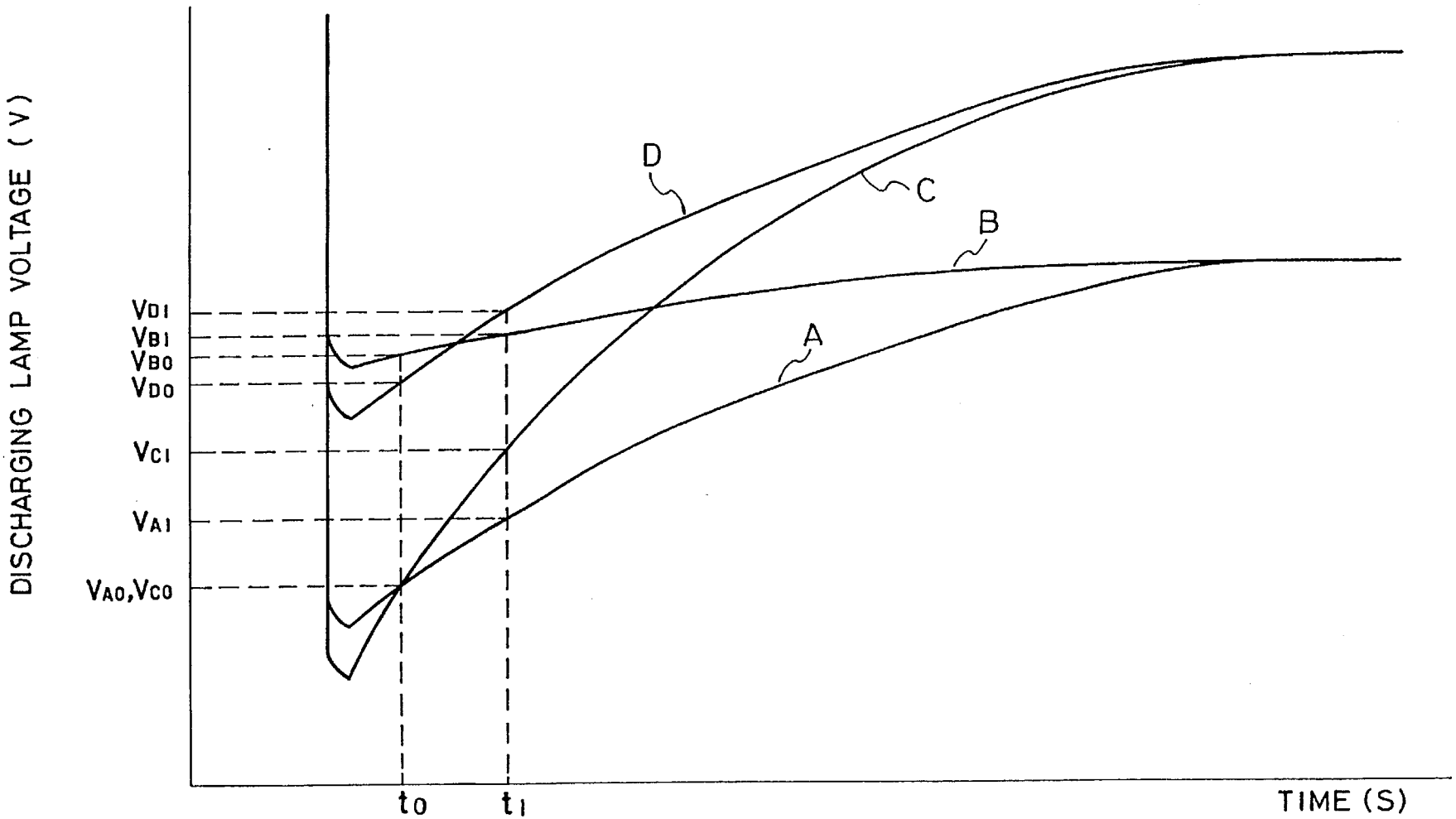
FIG. 12 is a time varying diagram of the discharging lamp voltages in the various discharging lamps according to the embodiment 1.

FIG. 12 is a time-varying diagram showing the discharging lamp voltage. Curves A and B have the same final discharging lamp voltage, and the curve A indicates lighting in a state where the discharging lamp is sufficiently cooled (hereinafter referred to as cold start) and the curve B indicates lighting in a state where the discharging lamp is warmed (hereinafter referred to as hot start). Though curves C and D also have the same final discharging lamp voltage, values thereof are greater than those of the curves A and B. The curve C indicates the cold start, and the curve D indicates the hot start.

As seen from FIG. 12, the discharging lamp voltage once drops after dielectric breakdown, and thereafter gradually rises toward the final discharging lamp voltage. In the course of dropping of the discharging lamp voltage, there is no visible difference between the four curves, and a remarkable difference can be found after the discharging lamp voltage is started to rise.

The curve A will be discussed hereinafter. First, it is assumed that discharging lamp voltage (prediction starting voltage) at any given time after the discharging lamp voltage is minimized is defined as discharging lamp voltage $V_{A0}$ at a time $t_0$. Next, another discharging lamp voltage at a time $t_1$ after the elapse of an appropriate predetermined time from the time $t_0$ is defined as $V_{A1}$. In this case, a time varying rate $\delta_A$ of the discharging lamp voltage can be found by the following expression:

$$\delta_A=(V_{A1}-V_{A0})/(t_1-t_0)$$

Similarly, time varying rates $\delta_B$, $\delta_C$, and $\delta_D$ of the curves B, C, and D can be found by the following expressions:

$$\delta_B=(V_{B1}-V_{B0})/(t_1-t_0)$$

$$\delta_C=(V_{C1}-V_{C0})/(t_1-t_0)$$

$$\delta_D=(V_{D1}-V_{D0})/(t_1-t_0)$$

FIG. 12 is a time varying diagram of the discharging lamp voltage, showing a discharging lamp voltage characteristic. In the time varying diagram, there are time variations in the discharging lamp voltage depending upon states of the discharging lamp and the final discharging lamp voltage at the lighting time, and the prediction starting voltage and the time varying rate also have various values depending on the time variations. For example, the curve B has a larger prediction starting voltage than that of the curve A, and the curve A has a larger time varying rate than that of the curve B, and the curves A and B has the same final discharging lamp voltage. The same holds true for the curves C and D. Typically, if the curves have the same final discharging lamp voltage, one of the curves having smaller prediction starting voltage has a larger time varying rate.

Making a comparison between the curves B and C, like the relationship between the curves A and B, the curve B has a larger prediction starting voltage, and the curve C has a larger time varying rate. However, the respective curves have different final discharging lamp voltages. Typically, the final discharging lamp voltages may be identical with each other, or may be different from one another even in case the curves have each different prediction starting voltage and different time varying rate.

In a comparison between the curves A and C, though the respective curves have the same prediction starting voltage, the curve C has a larger time varying rate and larger final discharging lamp voltage than those of the curve A. In general, in case the curves have the same prediction starting voltage, one of the curves having a larger time varying rate has the larger final discharging lamp voltage.

Between the curves A and D, the curve D has a larger prediction starting voltage, the respective curves have the same time varying rate, and the curve D also has larger final discharging lamp voltage. In general, in case the curves have the same time varying rate, one of the curves having the larger prediction starting voltage has the larger final discharging lamp voltage.

In view of the above facts, when the final discharging lamp voltage is predicted by finding the prediction starting voltage, the final discharging lamp voltages may be different from one another though the prediction starting voltage is constant as in the relationship between the curves A and C. That is, there are many curves intersecting a point ($t_0$, $V_{A0}$), and it is impossible to determine one curve by only the prediction starting voltage and to predict the final discharging lamp voltage. Alternatively, when the final discharging lamp voltage is predicted by finding the time varying rate, the final discharging lamp voltages may be different from one another even if the time varying rate is constant as in the relationship between the curves A and D. That is, there are many curves having the constant time varying rate for a certain time period, and it is impossible to determine one curve by only the time varying rate and to predict the final discharging lamp voltage. Hence, if the attention is given to both the prediction starting voltage and the time varying rate, for example, one curve A can be determined as a curve intersecting the point ($t_0$, $V_{A0}$) and having a time varying rate $\delta_A$ so that the final discharging lamp voltage can be defined automatically.

In this case, the time varying rate of the discharging lamp voltage for the prediction starting voltage having a certain value is experimentally found to provide the final discharging lamp voltage which is predicted from the time varying rate, thereby setting the discharging lamp voltage characteristic. Accordingly, it is possible to predict the final discharging lamp voltage after the discharging lamp lighting depending upon discharging lamp voltage at any desired time after the discharging lamp voltage is minimized, and discharging lamp voltage after the elapse of an appropriate predetermined time from the desired time. For example, in the curve A, if the discharging lamp voltage characteristic at a time of the prediction starting voltage $V_{A0}$ is selected, it is possible to determine only one voltage corresponding to the time varying rate $\delta_A$. The determined voltage can serve as the predicted final discharging lamp voltage.

The curve B is identical with the curve A in the final discharging lamp voltage, but differs from the curve A in the prediction starting voltage and the time varying rate. In the curve B, if a discharging lamp voltage characteristic at a time of the prediction starting voltage $V_{B0}$ is selected, it is possible to determine only one voltage corresponding to the time varying rate $\delta_B$, resulting in the determined voltage serving as the predicted final discharging lamp voltage. In this case, while the prediction starting voltages $V_{B0}$ and $V_{A0}$ are different from one another and the selected discharging lamp voltage characteristics are also different from one another, a corresponding characteristic is set such that the curve B has the same voltage corresponding to the time varying rate $\delta_B$ as that of the curve A. The same holds true for the curves C and D.

Further, the curve C is identical with the curve A in the prediction starting voltage, but differs from the curve A in the time varying rate and the final discharging lamp voltage. In the curve C, if a discharging lamp voltage characteristic at a time of the prediction starting voltage $V_{C0}$ is selected, it is possible to determine only one voltage corresponding to the time varying rate $\delta_C$, resulting in the determined voltage serving as the predicted final discharging lamp voltage. In this case, though the prediction starting voltages $V_{C0}$ and $V_{A0}$ are identical and the selected discharging lamp voltage characteristics are also identical, the time varying rates $\delta_C$ and $\delta_A$ are different from one another. Therefore, the discharging lamp voltage characteristic is set such that the curve C has voltage corresponding to the time varying rate $\delta_C$ which differs from that of the curve A.

In addition, the curve D is identical with the curve A in the time varying rate, but differs from the curve A in the prediction starting voltage and the final discharging lamp voltage. In the curve D, if a discharging lamp voltage characteristic at a time of the prediction starting voltage $V_{D0}$ is selected, it is possible to determine only one voltage corresponding to the time varying rate $\delta_D$, resulting in the determined voltage serving as the predicted final discharging lamp voltage. In this case, since the prediction starting voltages $V_{D0}$ and $V_{A0}$ are different from one another and the selected discharging lamp voltage characteristics are also different. Therefore, even if the time varying rates $\delta_D$ and $\delta_A$ are identical, the discharging lamp voltage characteristic is set such that the curve D has voltage corresponding to the time varying rate $\delta_D$ which differs from that of the curve A.

As a result, in any lighting state, it is possible to predict the final discharging lamp voltage by selecting one of the preset discharging lamp voltage characteristics after the discharging lamp lighting depending upon the discharging lamp voltage at any desired time after the discharging lamp voltage is minimized, and the discharging lamp voltage after the elapse of the appropriate predetermined time from the desired time.

A description will now be given of the operation of the predicting means 73 with reference to a flowchart shown in FIG. 13.

In the predicting means 73 provided for the discharging lamp control means 7, in ST13-1, it is decided whether or not the discharging lamp voltage $V_1$ fed from the voltage detecting means 6 is the minimum value. If the minimum value, it is decided whether or not an optionally predetermined time is reached in ST13-2. When the predetermined time is reached, in ST13-3, the predicting means 73 defines the discharging lamp voltage $V_1$ at that time as discharging lamp voltage $V_0$ (prediction starting voltage) at the time $t_0$.

Subsequently, in ST13-4, it is decided whether or not an appropriate predetermined time has elapsed from the time $t_0$. If the predetermined time has elapsed, in ST13-5, the predicting means 73 defines the discharging lamp voltage $V_1$ at this time as the discharging lamp voltage $V_1$ at a time $t_1$. In ST13-6, the time varying rate 6 of the discharging lamp voltage is found by the following expression:

$$\delta=(V_1-V_0)/(t_1-t_0)$$

In the predicting means 73, the time varying rate of the discharging lamp voltage for the prediction starting voltage having a certain value is experimentally found in advance to provide the final discharging lamp voltage predicted from the time varying rate, thereby setting discharging lamp voltage-current corresponding characteristics. In ST13-7, the discharging lamp voltage-current corresponding characteristic for the prediction starting voltage $V_0$ is selected. In ST13-8, only one voltage corresponding to the time varying rate $\delta$ is determined, and the determined value serves as the final discharging lamp voltage.

EMBODIMENT 2

Figure 14:
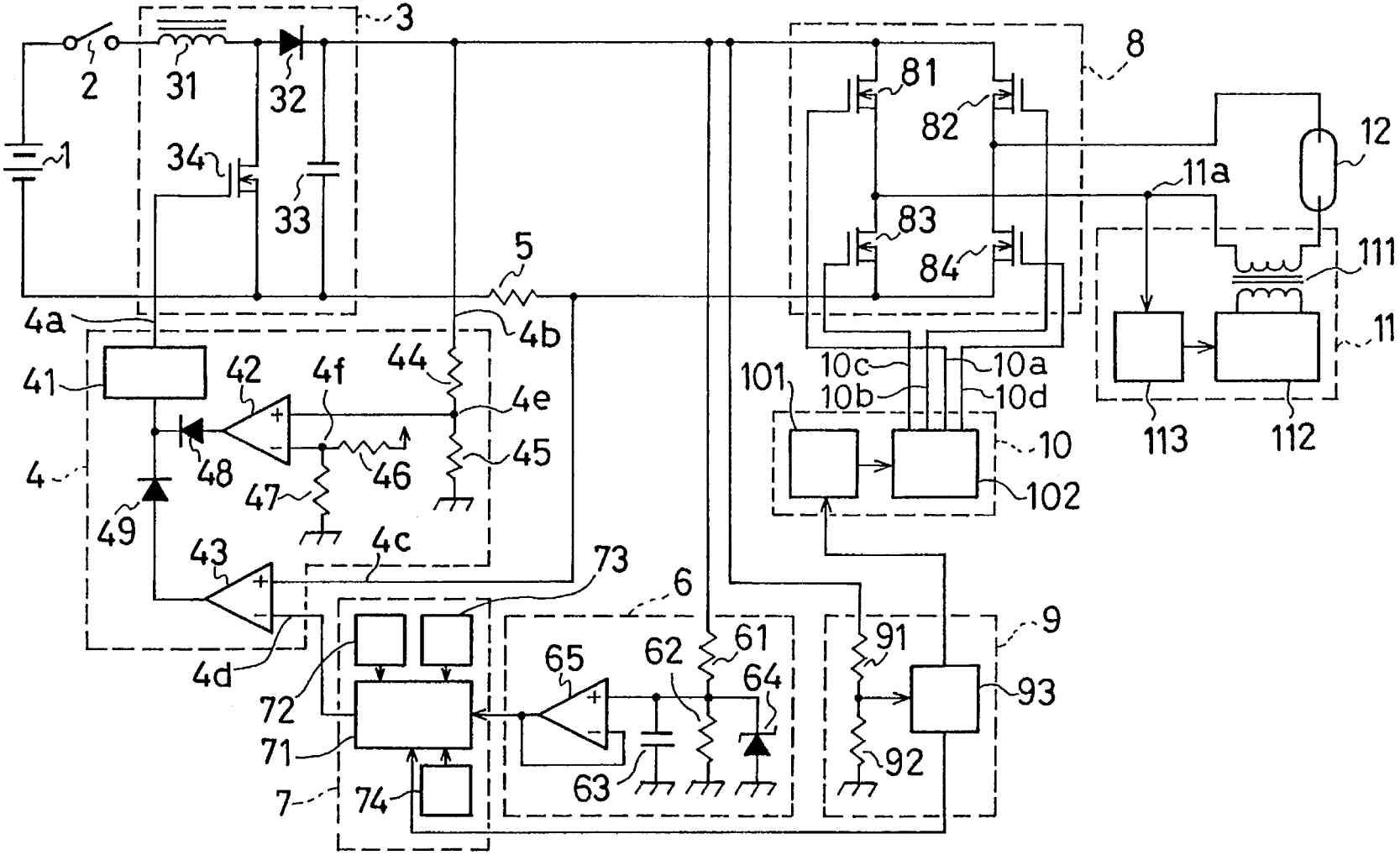
FIG. 14 is a block diagram showing a discharging lamp lighting apparatus according to the embodiment 2 of the present invention.

A description will now be given of the embodiment 2 of the present invention with reference to FIG. 14 in which the same reference numerals are used for component parts identical with those in the embodiment 1, and descriptions thereof are omitted. In FIG. 14, discharging lamp control means 7 includes processing means 71, a command discharging lamp current table 72, predicting means 73 for predicting final discharging lamp voltage before a discharging lamp 12 reaches a saturated and stable state, and final discharging lamp voltage storing means 74 for storing the final discharging lamp voltage of the discharging lamp 12.

Figure 15:
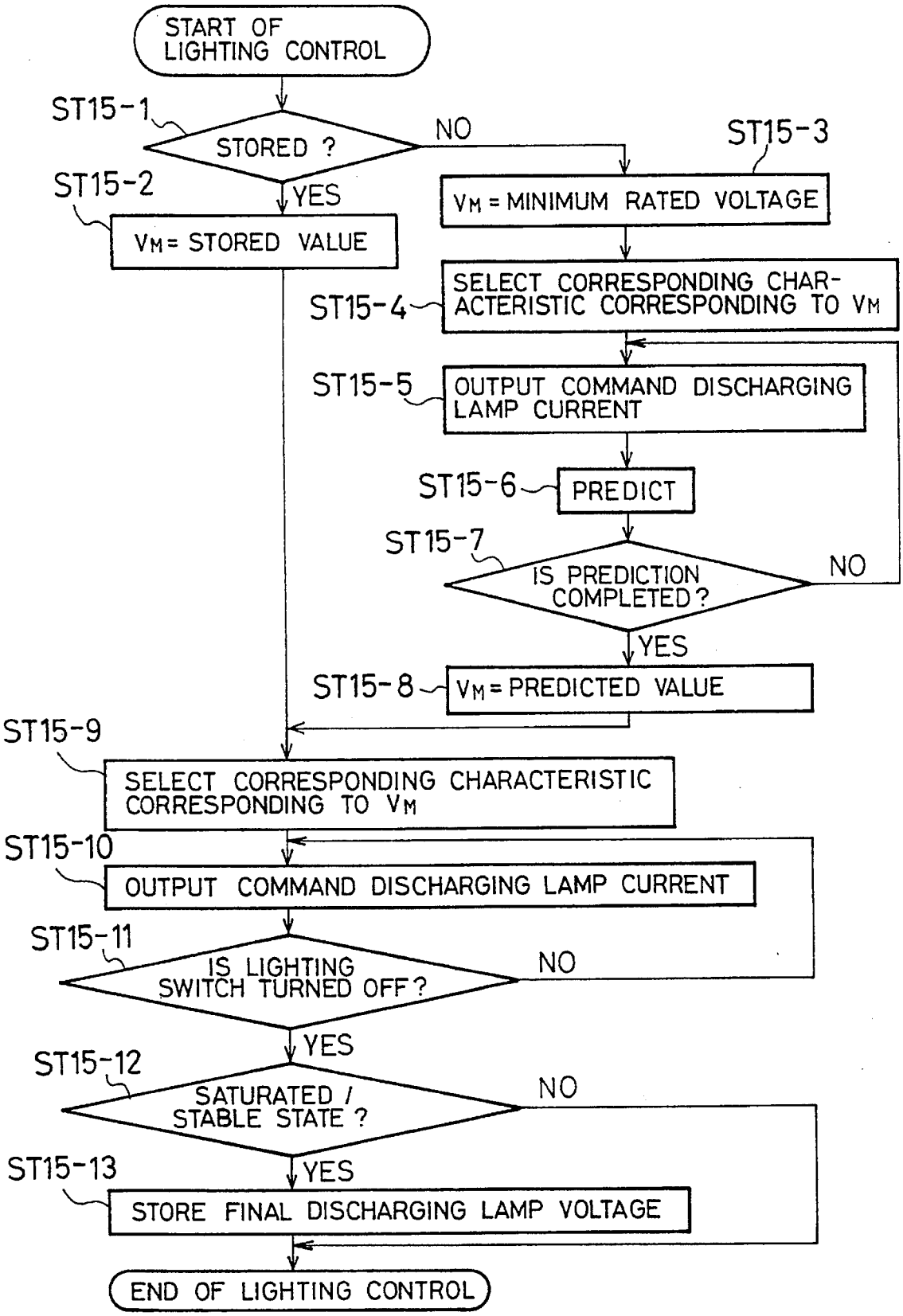
FIG. 15 is a flowchart diagram illustrating a lighting control operation according to the embodiment 2.

The embodiment 2 is identical with the embodiment 1 in the operation except the a method of controlling the discharging lamp control means 7, and descriptions thereof are omitted. Then, a description will be given of only the method of controlling the discharging lamp control means 7 with reference to a flowchart shown in FIG. 15.

In the discharging lamp control means 7, when discharging lamp voltage $V_1$ is transmitted from voltage detecting means 6, in ST15-1, the processing means 71 decides whether or not the final discharging lamp voltage is stored in the final discharging lamp voltage storing means 74. If the final discharging lamp voltage is stored, in ST15-2, the processing means 71 reads a stored value from the final discharging lamp voltage storing means 74 to define control target voltage $V_M$ as the stored value.

Otherwise, if the final discharging lamp voltage is not stored, in ST15-3, the processing means 71 defines the control target voltage $V_M$ as the preset minimum rated voltage in specification of the discharging lamp 12. Subsequently, in ST15-4, a discharging lamp voltage-current corresponding characteristic corresponding to the control target voltage $V_M$ is selected from discharging lamp voltage-current corresponding characteristics which are preset in the command discharging lamp current table 72. In ST15-5, according to the discharging lamp voltage $V_1$ transmitted from the voltage detecting means 6, command discharging lamp current $I_S$ applied to the discharging lamp 12 is read from the discharging lamp voltage-current corresponding characteristic selected in ST15-4 so as to output voltage corresponding to the command signal to an error amplifier 43.

Next, in ST15-6, the predicting means 73 starts to predict the final discharging lamp voltage. In ST15-7, the processing means 71 decides whether or not the predicting means 73 completes the prediction of the final discharging lamp voltage. Until the prediction is completed, the operation returns to ST15-5 to control according to the discharging lamp voltage-current corresponding characteristic selected in ST15-4. After completion of the prediction, in ST15-8, the final discharging lamp voltage predicted by the predicting means 73 is substituted for the minimum rated voltage in the specification of the discharging lamp 12 set in ST15-3 to serve as the control target voltage $V_M$.

In ST15-9, a discharging lamp voltage-current corresponding characteristic corresponding to the control target voltage $V_M$ set in ST15-2 or ST15-8 is selected from the command discharging lamp current table 72. In ST15-10, according to the discharging lamp voltage $V_1$ transmitted from the voltage detecting means 6, the command discharging lamp current $I_S$ applied to the discharging lamp 12 is read from the discharging lamp voltage-current corresponding characteristic selected in ST15-9 so as to output voltage corresponding to the command signal to the error amplifier 43.

In ST15-11, it is decided whether or not a lighting switch 2 is turned OFF, and the discharging lamp control means 7 outputs the voltage corresponding to the command signal to the error amplifier 43. When the lighting switch 2 is turned OFF, in ST15-12, it is decided whether or not the discharging lamp 12 is in the saturated and stable state. If in the saturated and stable state, in ST15-13, discharging lamp voltage at this time is stored in the final discharging lamp voltage storing means 74. An optional time reaching the saturated and stable state is experimentally predetermined to decide whether or not the optional time has elapsed, thereby confirming whether or not the discharging lamp 12 is in the saturated and stable state.

Figure 16:
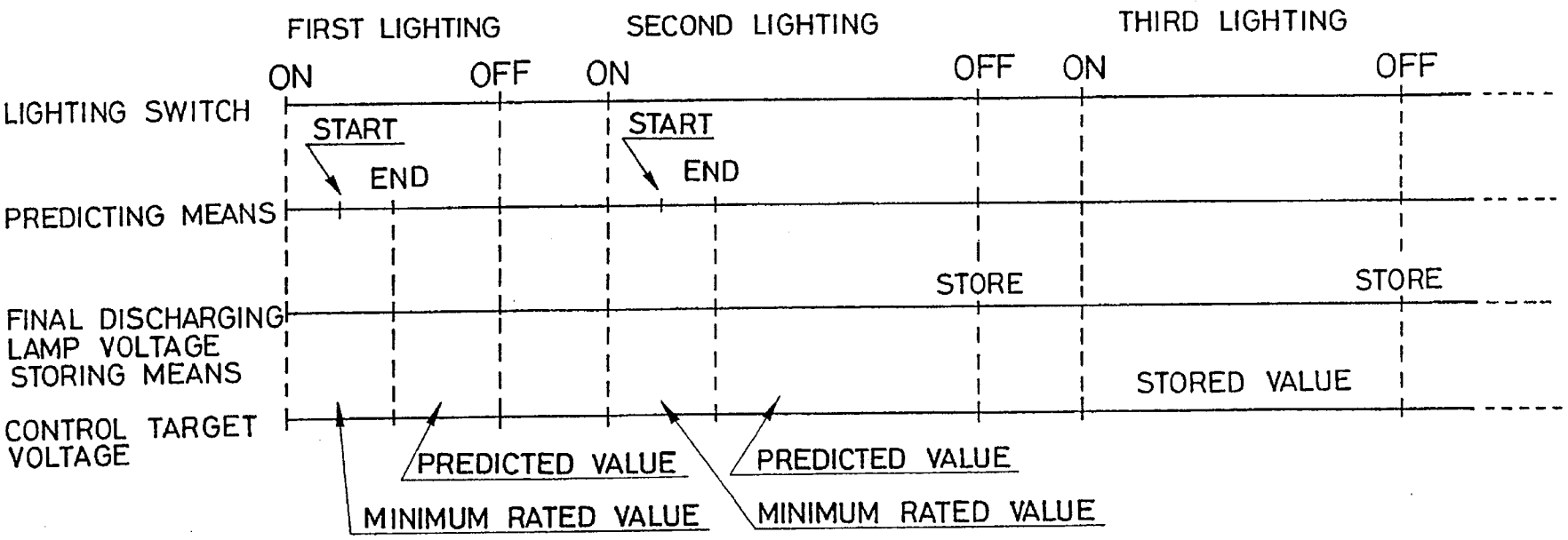
FIG. 16 is a timing diagram illustrating a control operation of discharging lamp control means according to the embodiment 2.

FIG. 16 shows one illustrative control of the discharging lamp control means 7. In the first lighting, since no stored value is present in the final discharging lamp voltage storing means 74, the control target voltage $V_M$ is defined as the previously stored minimum rated value of the discharging lamp, and a new discharging lamp voltage-current corresponding characteristic corresponding to the minimum rated value is selected to output the command discharging lamp current. On the other hand, the predicting means 73 starts to predict the final discharging lamp voltage, and the control target voltage $V_M$ is replaced with the predicted value at a time when the prediction is completed. Further, a discharging lamp voltage-current corresponding characteristic corresponding to the predicted value is selected to output the command discharging lamp current $I_S$ until the lighting switch 2 is turned OFF. In this case, it is assumed that the discharging lamp 12 is not in the saturated and stable state yet when the lighting switch 2 is turned OFF, and no voltage is stored in the final discharging lamp voltage storing means 74.

In the second lighting, since no stored value is present in the final discharging lamp voltage storing means 74, control is made as in the first lighting. When the lighting switch 2 is turned OFF in this state, the discharging lamp 12 is in the saturated and stable state, and discharging lamp voltage at this time is stored in the final discharging lamp voltage storing means 74.

Once the voltage is stored in the final discharging lamp voltage storing means 74, the control target voltage $V_M$ is defined as the stored value in the following lighting without the prediction. If the discharging lamp 12 is in the saturated and stable state when the lighting switch 2 is turned OFF, discharging lamp voltage at that time is stored in the final discharging lamp voltage storing means 74 for each OFF operation to serve as the control target voltage $V_M$ at the next lighting time.

EMBODIMENT 3

A description will now be given of lighting control in the embodiment 3 of the present invention with reference to a flowchart shown in FIG. 17. A hardware configuration in the embodiment 3 is identical with that in the embodiment 2 shown in FIG. 14. Further, the embodiment 3 is identical with the embodiment 1 in the operation except a method of controlling discharging lamp control means 7, and descriptions thereof are omitted. Therefore, only the method of controlling the discharging lamp control means 7 will be described.

In the discharging lamp control means 7, when discharging lamp voltage $V_1$ is transmitted from voltage detecting means 6, in ST17-1, processing means 71 decides whether or not final discharging lamp voltage is stored in final discharging lamp voltage storing means 74. If the final discharging lamp voltage is stored, in ST17-2, the processing means 71 reads a stored value from the final discharging lamp voltage storing means 74 to define control target voltage $V_M$ as the stored value. Otherwise, in ST17-3, $V_M$ is defined as the previously stored minimum rated voltage in specification of a discharging lamp 12.

Subsequently, in ST17-4, a discharging lamp voltage-current corresponding characteristic corresponding to the control target voltage $V_M$ is selected from discharging lamp voltage-current corresponding characteristics preset in a command discharging lamp current table 72. In ST17-5, according to the discharging lamp voltage $V_1$ transmitted from the voltage detecting means 6, command discharging lamp current $I_S$ applied to the discharging lamp 12 is read from the discharging lamp voltage-current corresponding characteristic selected in ST17-4 so as to output voltage corresponding to the command signal to an error amplifier 43.

Next, in ST17-6, predicting means 73 starts to predict the final discharging lamp voltage. Then, in ST17-7, the processing means 71 decides whether or not the predicting means 73 completes prediction of the final discharging lamp voltage. Until the prediction is completed, the operation returns to ST17-5 to control according to the discharging lamp voltage-current corresponding characteristic selected in ST17-4. After completion of the prediction, it is decided whether or not the stored value is present in ST17-8. If the stored value is present, in ST17-9, it is decided whether or not a difference between the stored value and a predicted value is less than a predetermined value. The predetermined value is experimentally predetermined. If less than the predetermined value, it is decided that the stored value is a correct value which is not affected by noise or the like. In ST17-10, the control target voltage $V_M$ is left defined as the stored value.

When a new discharging lamp is turned ON initially after exchange, the stored value is left as the final discharging lamp voltage in an old discharging lamp, and final discharging lamp voltage predicted for the new discharging lamp is different from that for the old discharging lamp. Then, in ST17-9, it is decided that the difference is equal to or more than the predetermined value. That is, in ST17-9, it is decided whether or not the stored value is the correct value which is not affected by the noise or the like, and the discharging lamp is exchanged.

If the stored value is absent in ST17-8, or if it is decided that the difference is equal to or more than the predetermined value in ST17-9, the control target voltage $V_M$ is defined as the predicted value in ST17-11.

Subsequently, in ST17-12, a discharging lamp voltage-current corresponding characteristic corresponding to the control target voltage $V_M$ set in ST17-10 or ST17-11 is selected from the command discharging lamp current table 72. In ST17-13, according to the discharging lamp voltage $V_1$ transmitted from the voltage detecting means 6, command discharging lamp current $I_S$ applied to the discharging lamp 12 is read from the discharging lamp voltage-current corresponding characteristic selected in ST17-12 so as to output voltage corresponding to the command signal to the error amplifier 43.

In ST17-14, it is decided whether or not the lighting switch 2 is turned OFF. Until the lighting switch 2 is turned OFF, the discharging lamp control means 7 outputs the voltage corresponding to the command signal to the error amplifier 43. When the lighting switch 2 is turned OFF, in ST17-15, it is decided whether or not the discharging lamp 12 is in a saturated and stable state. If in the saturated and stable state, in ST17-16, discharging lamp voltage at this time is stored in the final discharging lamp voltage storing means 74. An optional time reaching the saturated and stable state is experimentally predetermined to decide whether or not the optional time has elapsed, thereby confirming whether or not the discharging lamp 12 is in the saturated and stable state.

Figure 18:
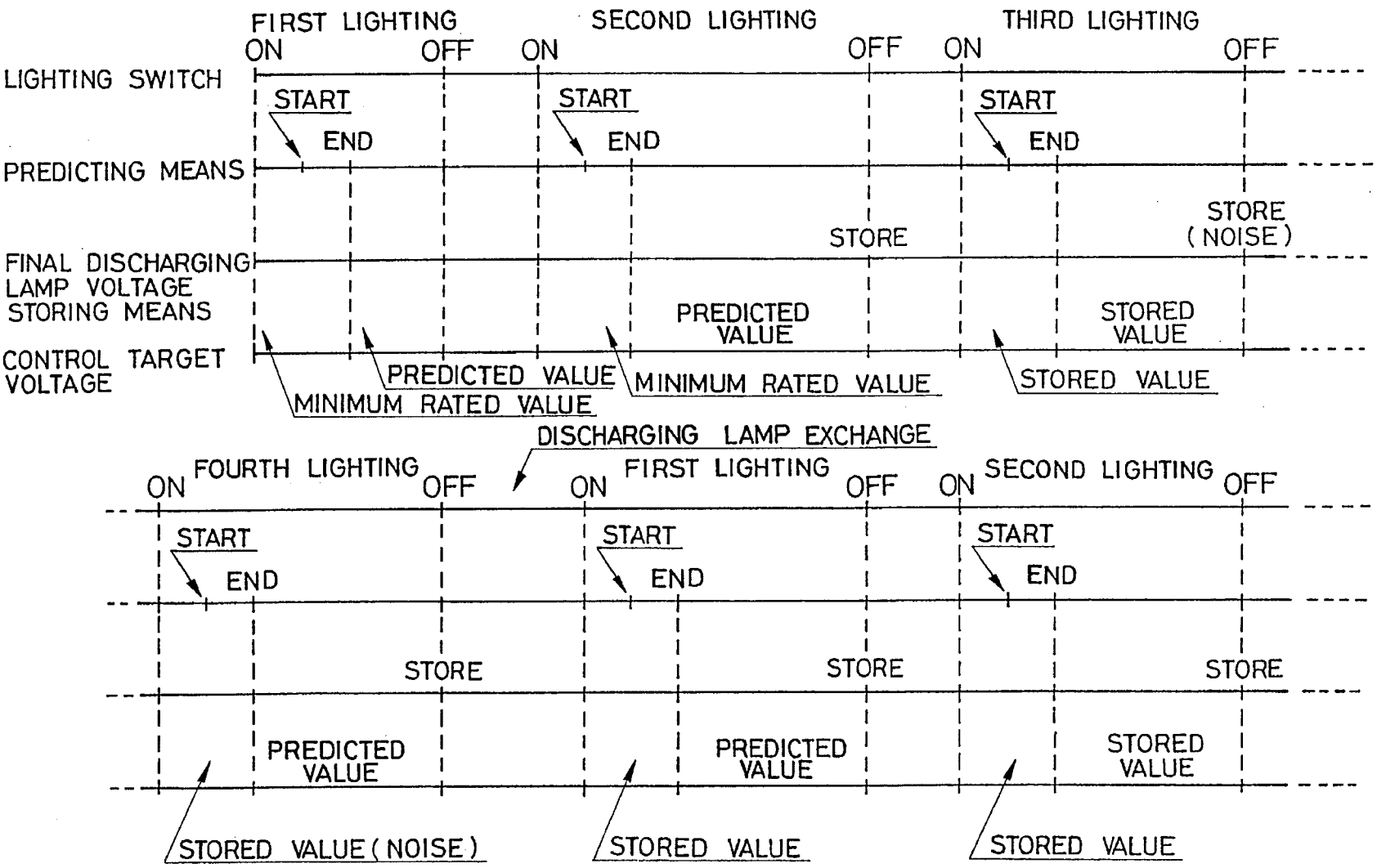
FIG. 18 is a timing diagram illustrating a control operation of discharging lamp control means according to the embodiment 3.

FIG. 18 shows one illustrative control of the discharging lamp control means 7 in the embodiment 3. In the first lighting, since no stored value is present in the final discharging lamp voltage storing means 74, the control target voltage $V_M$ is defined as the previously stored minimum rated value of the discharging lamp 12, and a discharging lamp voltage-current corresponding characteristic corresponding to the minimum rated value is selected to output the command discharging lamp current $I_S$.

On the other hand, the predicting means 73 starts to predict the final discharging lamp voltage, and the control target voltage $V_M$ is replaced with the predicted value at a time when the prediction is completed. Further, a new discharging lamp voltage-current corresponding characteristic corresponding to the predicted value is selected to output the command discharging lamp current $I_S$ until the lighting switch 2 is turned OFF. In this case, it is assumed that the discharging lamp 12 is not in the saturated and stable state yet when the lighting switch 2 is turned OFF, and no voltage is stored in the final discharging lamp voltage storing means 74.

In the second lighting, since no stored value is present in the final discharging lamp voltage storing means 74, control is made as in the first lighting. When the lighting switch 2 is turned OFF in this state, the discharging lamp 12 is in the saturated and stable state, and discharging lamp voltage at this time is stored in the final discharging lamp voltage storing means 74.

In the third lighting, since the final discharging lamp voltage storing means 74 has the stored value which is stored at the second light-out time, the control target voltage $V_M$ is defined as the stored value. Further, a discharging lamp voltage-current corresponding characteristic corresponding to the stored value is selected to output the command discharging lamp current $I_S$. On the other hand, the predicting means 73 starts to predict the final discharging lamp voltage to calculate whether or not a difference between the stored value and a predicted value is less than the predetermined value at a time when the prediction is completed. The stored value at the second light-out time is not affected by the noise or the like so that the difference becomes less than the predetermined value as a result of the calculation, and the control is performed with the control target voltage $V_M$ left defined as the stored value. In this case, it is assumed that the discharging lamp 12 is in the saturated and stable state when the lighting switch 2 is turned OFF again, and while discharging lamp voltage at this time is stored in the final discharging lamp voltage storing means 74, the stored value is affected by the noise to be different from an actual value.

In the fourth lighting, since the final discharging lamp voltage storing means 74 has the stored value which is stored at the third light-out time, the control target voltage $V_M$ is defined as the stored value. Further, a discharging lamp voltage-current corresponding characteristic corresponding to the stored value is selected to output the command discharging lamp current $I_S$. On the other hand, the predicting means 73 starts to predict the final discharging lamp voltage to calculate whether or not a difference between the stored value and a predicted value is less than the predetermined value at a time when the prediction is completed. The stored value at the third light-out time is affected by the noise so that the difference is equal to or more than the predetermined value as a result of the calculation, and the control is performed after the control target voltage $V_M$ is replaced with the predicted value.

Here, it is assumed that the discharging lamp 12 is exchanged for new one. In this case, the final discharging lamp voltage storing means 74 has the stored value which is stored at the fourth light-out time in the old discharging lamp when the new discharging lamp is initially turned ON. Consequently, the control target voltage $V_M$ is defined as the stored value, and a discharging lamp voltage-current corresponding characteristic corresponding to the stored value is selected to output the command discharging lamp current $I_S$. On the other hand, the predicting means 73 starts to predict the final discharging lamp voltage to calculate whether or not a difference between the stored value and a predicted value is less than the predetermined value at a time when the prediction is completed. The discharging lamp 12 is exchanged so that the difference is equal to or more than the predetermined value as a result of the calculation, and the control is performed after the control target voltage is replaced with the predicted value.

In the second lighting of the discharging lamp 12, the final discharging lamp voltage storing means 74 has the stored value which is stored at the first light-out time. Therefore, the control target voltage is defined as the stored value, and a discharging lamp voltage-current corresponding characteristic corresponding to the stored value is selected to output the command discharging lamp current. On the other hand, the predicting means 73 starts to predict the final discharging lamp voltage to calculate whether or not a difference between the stored value and a predicted value is less than the predetermined value at a time when the prediction is completed. The stored value at the first light-out time is not affected by the noise or the like so that the difference is less than the predetermined value as a result of the calculation, and the control is performed with the control target voltage $V_M$ left defined as the stored value.

The similar control is made for each later lighting.

EMBODIMENT 4

Figure 19:
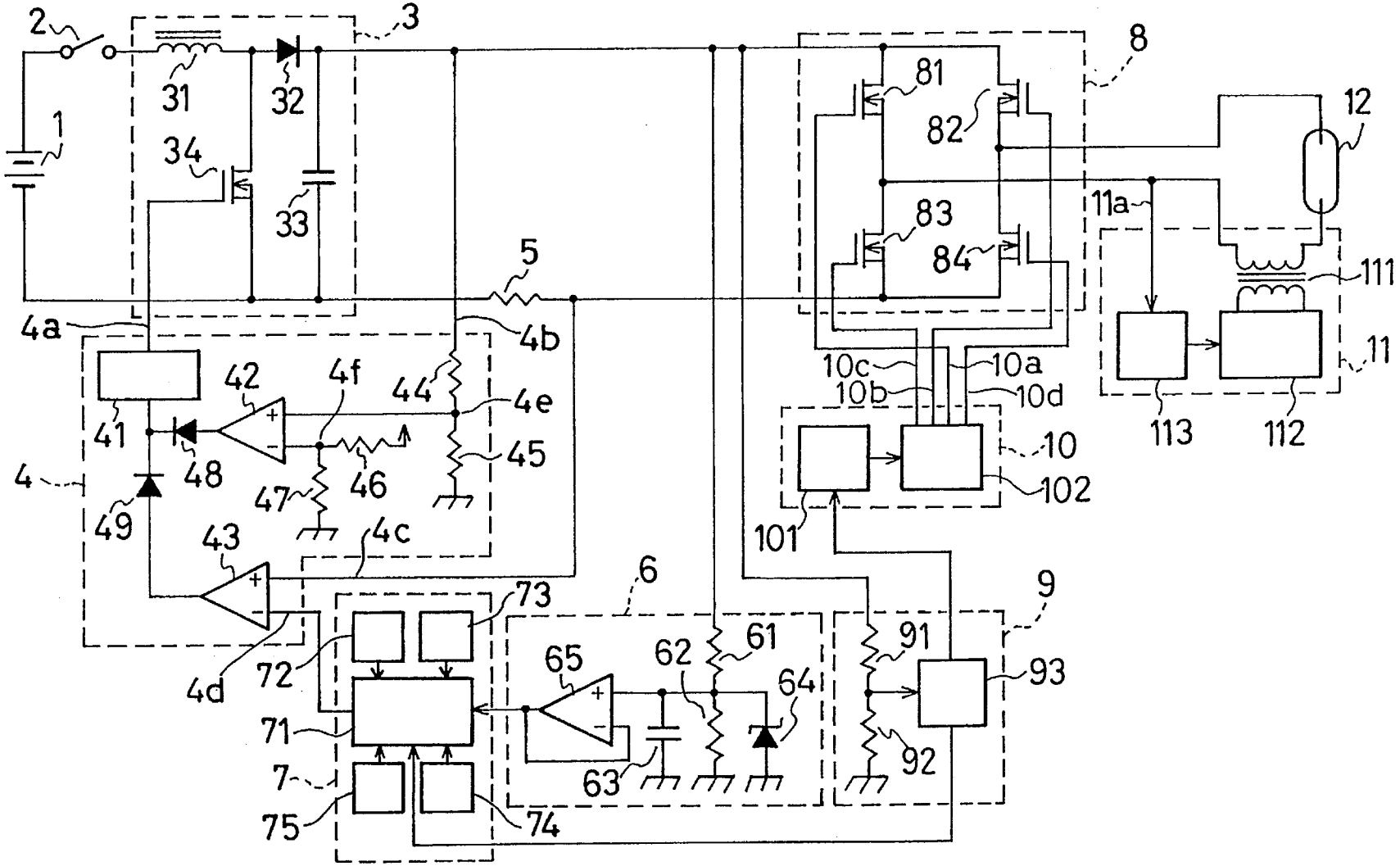
FIG. 19 is a block diagram showing a discharging lamp lighting apparatus according to the embodiment 4 of the present invention.

A description will now be given of the embodiment 4 of the present invention with reference to a flowchart shown in FIG. 19 in which the same reference numerals are used for component parts identical with those in FIG. 14, and descriptions thereof are omitted. In FIG. 19, discharging lamp control means 7 includes processing means 71, a command discharging lamp current table 72, predicting means 73 for predicting final discharging lamp voltage before a discharging lamp 12 reaches a saturated and stable state, final discharging lamp voltage storing means 74 for storing the final discharging lamp voltage of the discharging lamp 12, and predicted final discharging lamp voltage storing means 75 for storing final discharging lamp voltage predicted by the predicting means 73.

The embodiment 4 is identical with the embodiment 1 in the operation except the a method of controlling the discharging lamp control means 7, and descriptions thereof are omitted. Therefore, a description will be given of only the method of controlling the discharging lamp control means 7 with reference to a flowchart shown in FIG. 20.

In the discharging lamp control means 7, when discharging lamp voltage $V_1$ is transmitted from voltage detecting means 6, in ST20-1, the processing means 71 decides whether or not the final discharging lamp voltage is stored in the final discharging lamp voltage storing means 74. If the final discharging lamp voltage is stored, in ST20-2, the processing means 71 reads the final discharging lamp voltage from the final discharging lamp voltage storing means 74 to define control target voltage $V_M$ as the final discharging lamp voltage.

Otherwise, if the final discharging lamp voltage is not stored, in ST20-3, the processing means 71 decides whether or not predicted final discharging lamp voltage at a previous lighting time is stored in the predicted final discharging lamp voltage storing means 75. If the predicted final discharging lamp voltage is stored, in ST20-4, the processing means 71 reads the predicted final discharging lamp voltage from the predicted final discharging lamp voltage storing means 75 to define the control target voltage $V_M$ as the predicted final discharging lamp voltage.

Otherwise, if the predicted final discharging lamp voltage is not stored, in ST20-5, the control target voltage $V_M$ is defined as the preset minimum rated voltage in specification of the discharging lamp 12. Subsequently, in ST20-6, a corresponding characteristic corresponding to the control target voltage $V_M$ is selected from discharging lamp voltage-current corresponding characteristics which are preset in the command discharging lamp current table 72. In ST20-7, according to the discharging lamp voltage $V_1$ transmitted from the voltage detecting means 6, command discharging lamp current $I_S$ applied to the discharging lamp 12 is read from the discharging lamp voltage-current corresponding characteristic selected in ST20-6 so as to output voltage corresponding to the command signal to an error amplifier 43.

Next, in ST20-8, the predicting means 73 starts to predict the final discharging lamp voltage. The processing means 71 decides whether or not the predicting means 73 completes the prediction of the final discharging lamp voltage in ST20-9. Until the prediction is completed, the operation returns to ST20-7 to control according to the discharging lamp voltage-current corresponding characteristic selected in ST20-6. After completion of the prediction, in ST20-10, the final discharging lamp voltage predicted by the predicting means 73 is stored in the predicted final discharging lamp voltage storing means 75. In ST20-11, the final discharging lamp voltage predicted by the predicting means 73 is substituted for the value set in ST20-4 or ST20-5 to serve as the control target voltage $V_M$.

In ST20-12, a corresponding characteristic corresponding to the control target voltage $V_M$ set in ST20-2 or ST20-11 is selected from the command discharging lamp current table 72. In ST20-13, according to the discharging lamp voltage $V_1$ transmitted from the voltage detecting means 6, the command discharging lamp current $I_S$ applied to the discharging lamp 12 is read from the discharging lamp voltage-current corresponding characteristic selected in ST20-12 so as to output voltage corresponding to the command signal to the error amplifier 43.

In ST20-14, it is decided whether or not a lighting switch 2 is turned OFF, and the discharging lamp control means 7 outputs the voltage corresponding to the command signal to the error amplifier 43. When the lighting switch 2 is turned OFF, in ST20-15, it is decides whether or not the discharging lamp 12 is in the saturated and stable state. If in the saturated and stable state, in ST20-16, discharging lamp voltage at this time is stored in the final discharging lamp voltage storing means 74. An optional time reaching the saturated and stable state is experimentally predetermined to decide whether or not the optional time has elapsed, thereby confirming whether or not the discharging lamp 12 is in the saturated and stable state.

Figure 21:
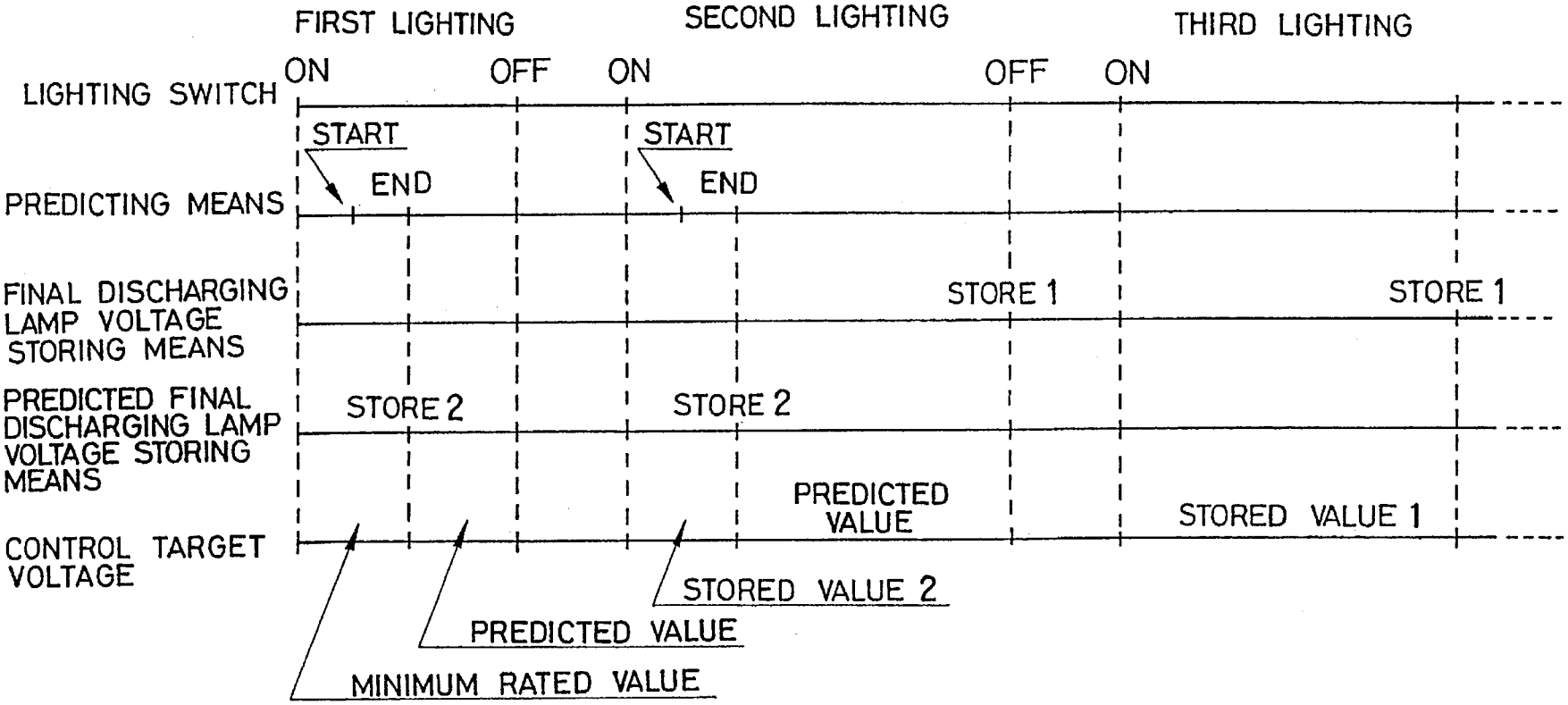
FIG. 21 is a timing diagram illustrating a control operation of discharging lamp control means according to the embodiment 4.

FIG. 21 shows one illustrative control of the discharging lamp control means 7 in the embodiment 4. In the first lighting, since no stored value is present in the final discharging lamp voltage storing means 74 and the predicted final discharging lamp voltage storing means 75, the control target voltage $V_M$ is defined as the previously stored minimum rated value of the discharging lamp 12, and a new discharging lamp voltage-current corresponding characteristic corresponding to the minimum rated value is selected to output the command discharging lamp current $I_S$.

On the other hand, the predicting means 73 starts to predict the final discharging lamp voltage, the final discharging lamp voltage predicted by the predicting means 73 is stored in the predicted final discharging lamp voltage storing means 75 at a time when the prediction is completed. Further, the control target voltage $V_M$ is replaced with the predicted final discharging lamp voltage, and a new discharging lamp voltage-current corresponding characteristic corresponding to the predicted final discharging lamp voltage is selected to output the command discharging lamp current $I_S$ until the lighting switch 2 is turned OFF. In this case, it is assumed that the discharging lamp is not in the saturated and stable state yet when the lighting switch 2 is turned OFF, and no voltage is stored in the final discharging lamp voltage storing means 74.

In the second lighting, the stored value is present not in the final discharging lamp voltage storing means 74 but in the predicted final discharging lamp voltage storing means 75. Therefore, the control target voltage $V_M$ is defined as the predicted final discharging lamp voltage at the previous lighting time which is stored in the predicted final discharging lamp voltage storing means 75, thereby performing the control.

On the other hand, as in the first lighting, the predicting means 73 starts to predict the final discharging lamp voltage, new final discharging lamp voltage predicted by the predicting means 73 is stored in the predicted final discharging lamp voltage storing means 75 at a time when the prediction is completed. Further, the control target voltage $V_M$ is replaced with the new predicted final discharging lamp voltage to perform the control. In this case, it is assumed that the discharging lamp 12 is in the saturated and stable state when the lighting switch 2 is turned OFF again, and discharging lamp voltage at this time is stored in the final discharging lamp voltage storing means 74.

Once the voltage is stored in the final discharging lamp voltage storing means 74, the control target voltage $V_M$ is defined as the stored value which is stored in the final discharging lamp voltage storing means 74 in a later lighting, resulting in no prediction. If the discharging lamp 12 is in the saturated and stable state when the lighting switch 2 is turned OFF, discharging lamp voltage at that time is stored in the final discharging lamp voltage storing means 74 for each OFF operation to serve as the control target voltage at the next lighting time.

EMBODIMENT 5

A description will now be given of lighting control in the embodiment 5 of the present invention with reference to a flowchart shown in FIG. 22. A hardware configuration in the embodiment 5 is identical with that in the embodiment 4 shown in FIG. 19. Further, the embodiment 5 is identical with the embodiment 1 in the operation except a method of controlling discharging lamp control means 7, and descriptions thereof are omitted. Therefore, only the method of controlling the discharging lamp control means 7 will be described.

In the discharging lamp control means 7, when discharging lamp voltage $V_1$ is transmitted from voltage detecting means 6, in ST22-1, processing means 71 decides whether or not final discharging lamp voltage is stored in final discharging lamp voltage storing means 74. If the final discharging lamp voltage is stored, in ST22-2, the processing means 71 decides whether or not a difference between a stored value in final discharging lamp voltage storing means 74 and a stored value in predicted final discharging lamp voltage storing means 75 is less than a predetermined value. The predetermined value is experimentally predetermined. If less than the predetermined value, it is decided that the stored value in the final discharging lamp voltage storing means 74 is a correct value which is not affected by noise or the like. In ST22-4, the control target voltage $V_M$ is defined as the final discharging lamp voltage.

When a new discharging lamp is turned ON initially after exchange, the stored value in the final discharging lamp voltage storing means 74 is left defined as the final discharging lamp voltage in an old discharging lamp, and final discharging lamp voltage predicted for the new discharging lamp is different from that for the old discharging lamp. Then, in ST22-2, it is decided that the difference is equal to or more than the predetermined value. That is, in ST22-2, it is decided whether or not the stored value in the final discharging lamp voltage storing means 74 is the correct value which is not affected by the noise or the like, and the discharging lamp is exchanged.

If it is decided that the difference is equal to or more than the predetermined value in ST22-2, in ST22-5, the control target voltage $V_M$ is defined as predicted final discharging lamp voltage at a previous lighting time stored in the predicted final discharging lamp voltage storing means 75.

If the final discharging lamp voltage is not stored in the final discharging lamp voltage storing means 74 in ST22-1, in ST22-3, it is decided whether or not the predicted final discharging lamp voltage at the previous lighting time is stored in the predicted final discharging lamp voltage storing means 75. If the predicted final discharging lamp voltage is stored, in ST22-5, the processing means 71 reads the stored value from the predicted final discharging lamp voltage storing means 75 to define the control target voltage $V_M$ as the predicted final discharging lamp voltage. Otherwise, in ST22-6, the control target voltage $V_M$ is defined as the previously stored minimum rated voltage in specification of the discharging lamp 12.

Subsequently, in ST22-7, a discharging lamp voltage-current corresponding characteristic corresponding to the control target voltage $V_M$ is selected from the discharging lamp voltage-current corresponding characteristics preset in the command discharging lamp current table 72. In ST22-8, according to the discharging lamp voltage $V_1$ transmitted from the voltage detecting means 6, command discharging lamp current $I_S$ applied to the discharging lamp 12 is read from the discharging lamp voltage-current corresponding characteristic selected in ST22-7 so as to output voltage corresponding to the command signal to an error amplifier 43.

Next, in ST22-9, the predicting means 73 starts to predict the final discharging lamp voltage. In ST22-10, the processing means 71 decides whether or not the predicting means 73 completes the prediction of the final discharging lamp voltage. Until the prediction is completed, the operation returns to ST22-8 to control according to the discharging lamp voltage-current corresponding characteristic selected in ST22-7. After completion of the prediction, in ST22-11, the final discharging lamp voltage predicted by the predicting means 73 is stored in the predicted final discharging lamp voltage storing means 75. In ST22-12, it is decided whether or not the stored value is present in the final discharging lamp voltage storing means 74. If the stored value is present, in ST22-13, it is decided whether or not a difference between the stored value in the final discharging lamp voltage storing means 74 and the predicted value predicted in ST22-9 is less than a predetermined value. The predetermined value is experimentally predetermined. In ST22-13 as in ST22-2, it is decided that the stored value in the final discharging lamp voltage storing means 74 is a correct value which is not affected by noise or the like, and the discharging lamp is exchanged. If less than the predetermined value, In ST22-14, the control target voltage $V_M$ is left defined as the stored value in the final discharging lamp voltage storing means 74.

If the stored value is not present in the final discharging lamp voltage storing means 74 in ST22-12, or if it is decided that the difference is equal to or more than the predetermined value in ST22-13, in ST22-15, the control target voltage $V_M$ is defined as the predicted value predicted in ST22-9.

Subsequently, in ST22-16, a discharging lamp voltage-current corresponding characteristic corresponding to the control target voltage $V_M$ set in ST22-14 or ST22-15 is selected from the command discharging lamp current table 72. In ST22-17, according to the discharging lamp voltage $V_1$ transmitted from the voltage detecting means 6, command discharging lamp current $I_S$ applied to the discharging lamp 12 is read from the discharging lamp voltage-current corresponding characteristic selected in ST22-16 so as to output voltage corresponding to the command signal to the error amplifier 43.

In ST22-18, it is decided whether or not a lighting switch 2 is turned OFF. Until the lighting switch 2 is turned OFF, the discharging lamp control means 7 outputs the voltage corresponding to the command signal to the error amplifier 43. When the lighting switch 2 is turned OFF, in ST22-19, it is decided whether or not the discharging lamp 12 is in a saturated and stable state. If in the saturated and stable state, in ST22-20, discharging lamp voltage at this time is stored in the final discharging lamp voltage storing means 74. An optional time reaching the saturated and stable state is experimentally predetermined to decide whether or not the optional time has elapsed, thereby confirming whether or not the discharging lamp 12 is in the saturated and stable state.

Figure 23:
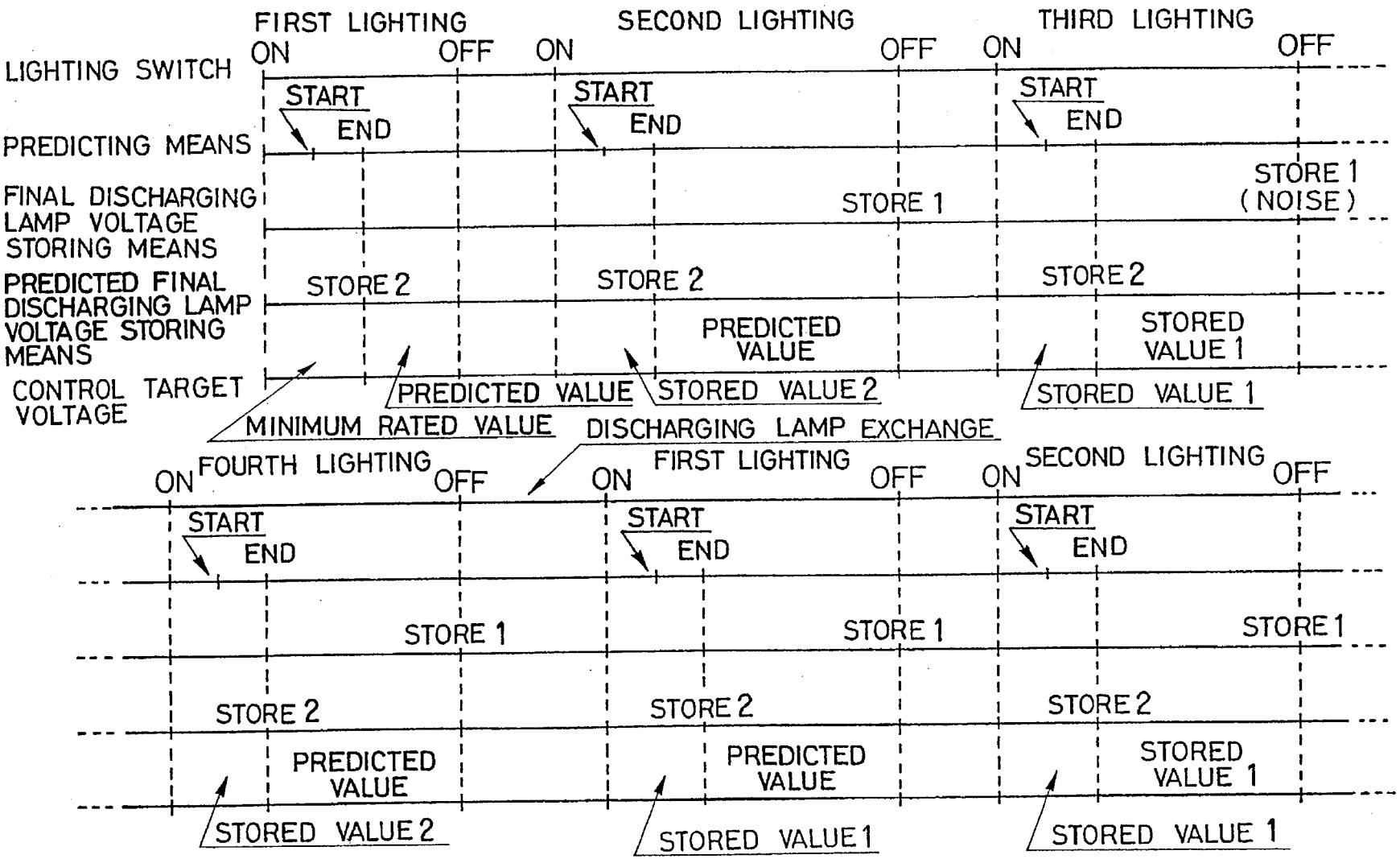
FIG. 23 is a timing diagram illustrating a control operation of discharging lamp control means according to the embodiment 5.
Figure 24:
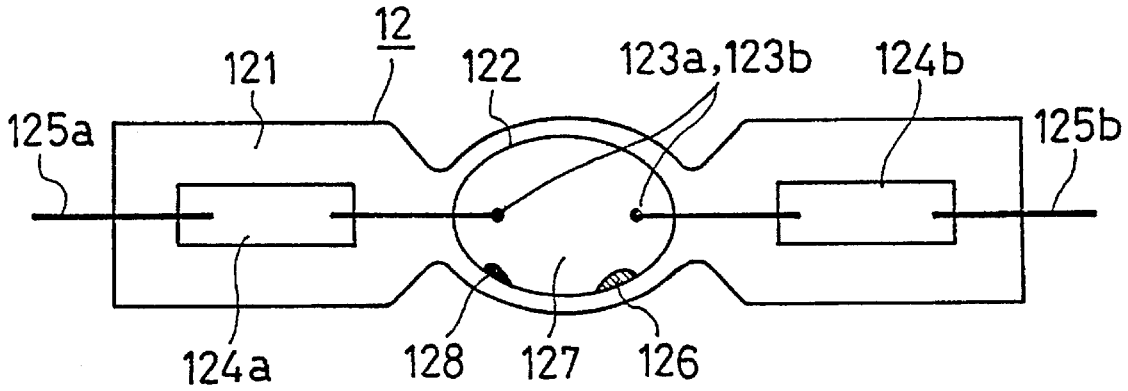
FIG. 24 (PRIOR ART)
FIG. 24 is a general view of a metal halide lamp serving as a discharging lamp.
Figure 25:
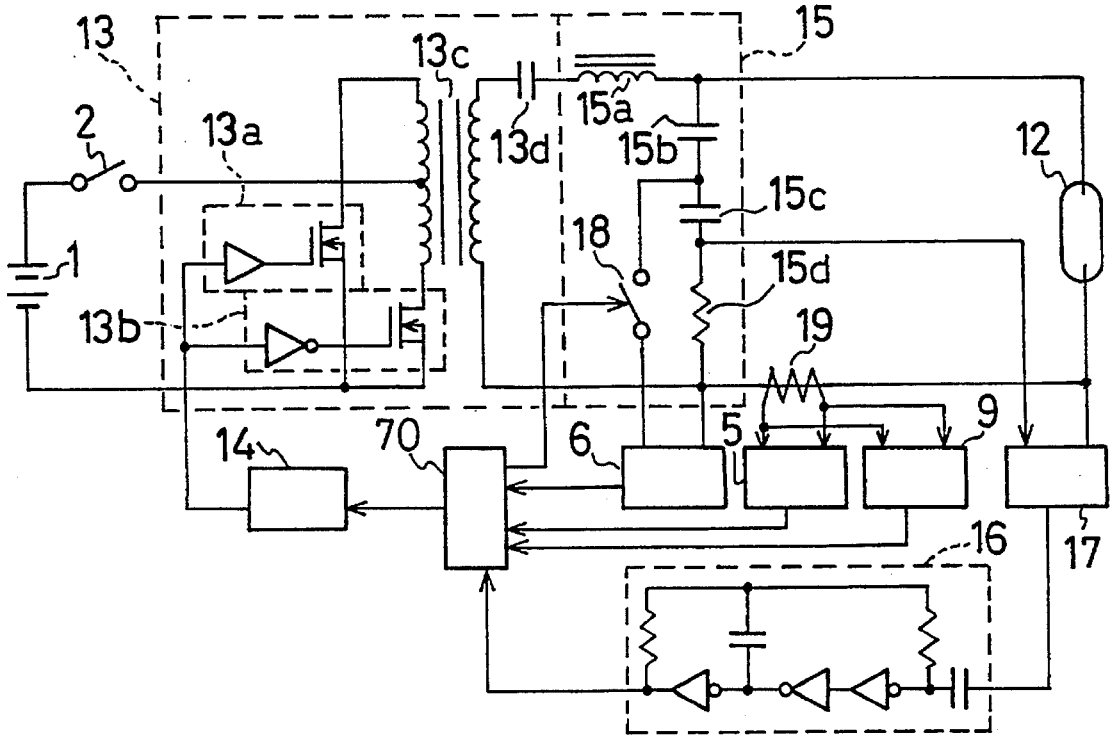
FIG. 25 (PRIOR ART)
FIG. 25 is a block diagram showing a conventional discharging lamp lighting apparatus.
Figure 26:
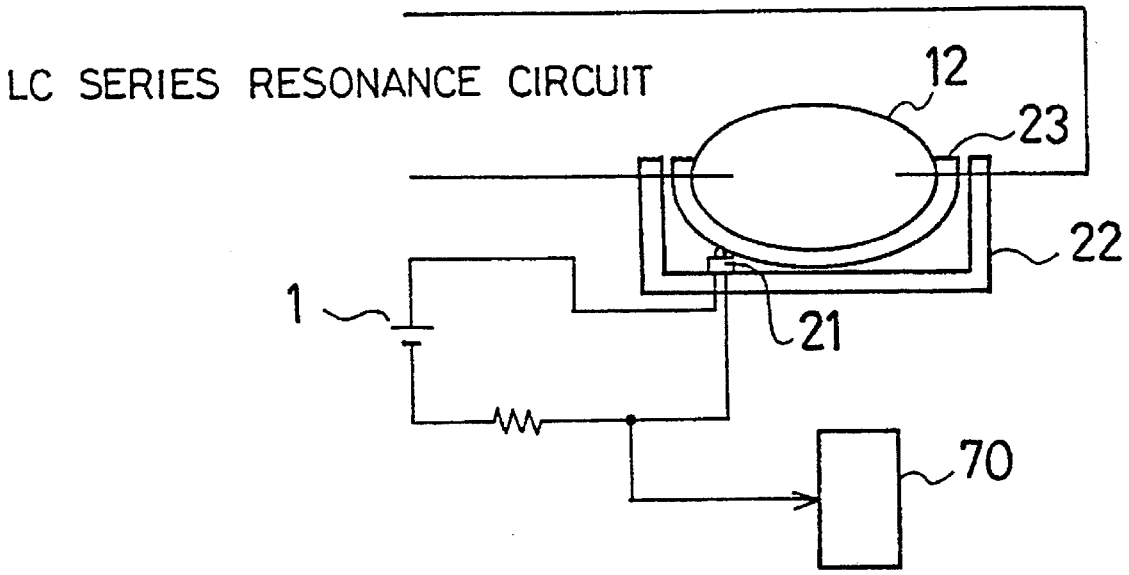
FIG. 26 (PRIOR ART)
FIG. 26 is a diagram showing a detailed periphery of the metal halide lamp.

FIG. 23 shows one illustrative control of the discharging lamp control means 7 in the embodiment 5. In the first lighting, since no stored value is present in the final discharging lamp voltage storing means 74 and the predicted final discharging lamp voltage storing means the control target voltage $V_M$ is defined as the previously stored minimum rated value of the discharging lamp 12, and a discharging lamp voltage-current corresponding characteristic corresponding to the minimum rated value is selected to output the command discharging lamp current $I_S$.

On the other hand, the predicting means 73 starts to predict the final discharging lamp voltage, and the final discharging lamp voltage predicted by the predicting means 73 is stored in the predicted final discharging lamp voltage storing means 75 at a time when the prediction is completed. Further, the control target voltage $V_M$ is replaced with the predicted final discharging lamp voltage to select a new corresponding characteristic corresponding to the predicted final discharging lamp voltage so as to output the command discharging lamp current $I_S$ until the lighting switch 2 is turned OFF. In this case, it is assumed that the discharging lamp 12 is not in the saturated and stable state yet when the lighting switch 2 is turned OFF, and no voltage is stored in the final discharging lamp voltage storing means 74.

In the second lighting, since the stored value is present not in the final discharging lamp voltage storing means 74 but in the predicted final discharging lamp voltage storing means 75, the control target voltage $V_M$ is defined as the predicted final discharging lamp voltage at the previous lighting time which is stored in the predicted final discharging lamp voltage storing means 75, thereby performing the control. On the other hand, as in the first lighting, the predicting means 73 starts to predict the final discharging lamp voltage. When the prediction is completed, new final discharging lamp voltage predicted by the predicting means 73 is stored in the predicted final discharging lamp voltage storing means 75. Consequently, the control target voltage $V_M$ is replaced with the new predicted final discharging lamp voltage, thereby performing the control. When the lighting switch 2 is turned OFF in this state, the discharging lamp 12 is in the saturated and stable state, and discharging lamp voltage at this time is stored in the final discharging lamp voltage storing means 74.

In the third lighting, since the final discharging lamp voltage storing means 74 has the stored value which is stored at the second light-out time, a calculation is performed to decide whether or not a difference between a stored value in the final discharging lamp voltage storing means 74 and a stored value in the predicted final discharging lamp voltage storing means 75 is less than a predetermined value. The stored value in the final discharging lamp voltage storing means 74 at the second light-out time is not affected by the noise or the like so that the difference becomes less than the predetermined value as a result of the calculation. The control target voltage $V_M$ is defined as the stored value in the final discharging lamp voltage storing means 74, and a discharging lamp voltage-current corresponding characteristic corresponding to the stored value is selected to output the command discharging lamp current $I_S$.

On the other hand, the predicting means 73 starts to predict the final discharging lamp voltage, and new final discharging lamp voltage predicted by the predicting means 73 is stored in the predicted final discharging lamp voltage storing means 75. Further, a calculation is performed to decide whether or not a difference between the stored value in the final discharging lamp voltage storing means 74 and a predicted value predicted by the predicting means 73 is less than the predetermined value. The stored value at the second light-out time is not affected by the noise or the like so that the difference becomes less than the predetermined value as a result of the calculation, and the control is continued with the control target voltage left defined as the stored value. In this case, it is assumed that the discharging lamp 12 is in the saturated and stable state when the lighting switch 2 is turned OFF again, and while discharging lamp voltage at this time is stored in the final discharging lamp voltage storing means 74, the stored value is affected by the noise to be different from an actual value.

In the fourth lighting, control is made as in the third lighting. Since the stored value in the final discharging lamp voltage storing means 74 is affected by the noise, the difference is equal to or more than the predetermined value as a result of the calculation. Therefore, until the prediction is completed, the control target voltage $V_M$ is defined as the final discharging lamp voltage predicted at the third lighting. After completion of the prediction, the control target voltage $V_M$ is replaced with a new predicted value to perform the control.

Here, it is assumed that the discharging lamp 12 is exchanged for new one. In this case, the stored value stored at a lighting time of the old discharging lamp is present in the final discharging lamp voltage storing means 74 and the predicted final discharging lamp voltage storing means 75 when the new discharging lamp is initially turned ON, but the difference is less than the predetermined value as a result of the calculation. Consequently, the control target voltage $V_M$ is defined as the stored value in the final discharging lamp voltage storing means 74, and a discharging lamp voltage-current corresponding characteristic corresponding to the stored value is selected to output the command discharging lamp current $I_S$.

On the other hand, the predicting means 73 starts to predict the final discharging lamp voltage, and new final discharging lamp voltage predicted by the predicting means 73 is stored in the predicted final discharging lamp voltage storing means 75 at a time the prediction is completed. Further, a calculation is performed to decide whether or not a difference between the stored value in the final discharging lamp voltage storing means 74 and a predicted value predicted by the predicting means 73 is less than the predetermined value. The discharging lamp 12 is exchanged so that the difference is equal to or more than the predetermined value as a result of the calculation, and the control is performed after the control target voltage $V_M$ is replaced with the predicted value.

In the second lighting, control is made as in the first lighting. In this case, since the stored value in the final discharging lamp voltage storing means 74 is not affected by the noise or the like, the difference is less than the predetermined value as a result of the calculation. Therefore, the control target voltage $V_M$ is defined as the stored value in the final discharging lamp voltage storing means 74.

The similar control is made for each later lighting.

As set forth above, according to the first aspect of the present invention, the discharging lamp lighting apparatus includes the predicting means for predicting the final discharging lamp voltage of the discharging lamp, and the discharging lamp control means for controlling the discharging lamp current depending upon the discharging lamp voltage-current corresponding characteristic selected by using the predicted value. As a result, there are the following several effects. It is possible to feed the optimal power to the discharging lamp according to the variation in the final discharging lamp voltage due to the quality or the operating time even at the initial lighting time or at the lighting time after the exchange of the discharging lamp, and reduce the time required for stability of the luminous flux. Further, since no means is required for detecting whether or not the discharging lamp is exchanged, it is possible to provide an inexpensive discharging lamp lighting apparatus.

According to the second aspect of the present invention, in the discharging lamp lighting apparatus, until the predicting means predicts the final discharging lamp voltage, the discharging lamp control means controls the discharging lamp current depending upon the discharging lamp voltage-current corresponding characteristic selected by using the previously stored minimum rated voltage of the discharging lamp. As a result, there is an effect in that it is possible to avoid overpower supply generating an excessive amount of light so as to prevent reduction of a lifetime of the discharging lamp.

According to the third aspect of the present invention, after the discharging lamp lighting, the predicting means predicts the final discharging lamp voltage by selecting one of the preset discharging lamp voltage characteristics depending upon the discharging lamp voltages at two optionally predetermined times after the discharging lamp voltage is minimized. As a result, there is an effect in that the final discharging lamp voltage can be easily provided.

According to the fourth aspect of the present invention, the discharging lamp lighting apparatus includes the predicting means and the final discharging lamp voltage storing means for storing the final discharging lamp voltage. As a result, only one lighting causes the final discharging lamp voltage storing means to store the final discharging lamp voltage, and it is possible to provide more accurate final discharging lamp voltage than would be in case only the predicting means is provided.

According to the fifth aspect of the present invention, in the discharging lamp lighting apparatus, the discharging lamp control means controls the discharging lamp current depending upon the discharging lamp voltage-current corresponding characteristic selected by using the stored value if the stored value of the final discharging lamp voltage is present in the final discharging lamp voltage storing means, otherwise, using the predicted value if the stored value is not present. As a result, there are effects in that it is possible to feed the optimal power to the discharging lamp according to the variation in the final discharging lamp voltage due to the quality or the operating time even when the stored value is not present, and reduce the time required for stability of the luminous flux.

According to the sixth aspect of the present invention, in the discharging lamp lighting apparatus, the discharging lamp control means controls the discharging lamp current depending upon the discharging lamp voltage-current corresponding characteristic selected by using the predicted value if the difference between the predicted value and the stored value of the final discharging lamp voltage in the final discharging lamp voltage storing means is equal to or more than the predetermined value, otherwise, using the stored value if less than the predetermined value. As a result, there are effects in that it is possible to feed the optimal power even if the stored value is affected by the noise or the like to be an incorrect value, or a new discharging lamp is initially turned ON after the exchange thereof, and provide an inexpensive discharging lamp lighting apparatus since no means is required for erasing the stored value after detecting whether or not the discharging lamp is exchanged.

According to the seventh aspect of the present invention, until the predicting means predicts the final discharging lamp voltage, the discharging lamp control means controls the discharging lamp current depending upon the discharging lamp voltage-current corresponding characteristic selected by using the stored value if the stored value of the final discharging lamp voltage is present in the final discharging lamp voltage storing means, otherwise, using the previously stored minimum rated voltage of the discharging lamp if the stored value is not present. As a result, there is an effect in that it is possible to avoid overpower supply generating an excessive amount of light so as to prevent reduction of a lifetime of the discharging lamp.

According to the eighth aspect of the present invention, the discharging lamp lighting apparatus includes the predicted final discharging lamp voltage storing means for storing the final discharging lamp voltage predicted by the predicting means. Until the predicting means predicts the final discharging lamp voltage, the discharging lamp voltage-current corresponding characteristic is selected by, in case the stored value of the final discharging lamp voltage is present in the final discharging lamp voltage storing means, using the stored value of the predicted final discharging lamp voltage if the difference between the stored value of the final discharging lamp voltage and the stored value of the predicted final discharging lamp voltage in the predicted final discharging lamp voltage storing means is equal to or more than the predetermined value, otherwise, using the stored value of the final discharging lamp voltage if less than the predetermined value, or by, in case only the stored value of the predicted final discharging lamp voltage is present in the predicted final discharging lamp voltage storing means, using the stored value of the predicted final discharging lamp voltage, or by, in case both the stored values are not present, using the previously stored minimum rated voltage of the discharging lamp. The discharging lamp current is controlled depending upon the selected discharging lamp voltage-current corresponding characteristic. As a result, there are effects in that it is possible to prevent the stored value affected by the noise or the like from being used, and feed the optimal power.

While preferred embodiments of the invention have been described using specific terms, such description is for illustrative purposes only, and it is to be understood that changes and variations may be made without departing from the spirit or scope of the following claims.

What is claimed is:

1. A discharging lamp lighting apparatus comprising:

storing means for previously storing a plurality of discharging lamp voltage-current characteristics indicative of a relationship between discharging lamp voltage and discharging lamp current of the discharging lamp to obtain a desired amount of emission of the discharging lamp;

predicting means for predicting a value of final discharging lamp voltage of said discharging lamp;

characteristic selecting means for selecting a one of said discharging lamp voltage-current characteristics identified by said final discharging lamp voltage predicted by said predicting means; and current control means for controlling actual discharging lamp current supplied to said discharging lamp to the current specified by said one of the discharging lamp voltage-current corresponding characteristics selected by said characteristic selecting means.

2. A discharging lamp lighting apparatus according to claim 1, wherein, until said predicting means predicts said final discharging lamp voltage, said characteristic selecting means uses a previously stored minimum rated voltage of said discharging lamp to select said discharging lamp voltage-current characteristic.

3. A discharging lamp lighting apparatus according to claim 1, wherein, after discharging lamp lighting, said predicting means predicts said final discharging lamp voltage by selecting one of preset discharging lamp voltage characteristics depending upon discharging lamp voltages at two optional times after the discharging lamp voltage is minimized.

4. A discharging lamp lighting apparatus according to claim 1, further comprising:

final discharging lamp voltage storing means for storing said final discharging lamp voltage of said discharging lamp.

5. A discharging lamp lighting apparatus according to claim 4, wherein said characteristic selecting means selects said discharging lamp voltage-current characteristic by using a stored value if said stored value of said final discharging lamp voltage is present in said final discharging lamp voltage storing means, otherwise, using said predicted value if said stored value is not present.

6. A discharging lamp lighting apparatus according to claim 4, wherein said characteristic selecting means selects said discharging lamp voltage-current characteristic by, in case an absolute value of difference between a predicted value of said predicting means and a stored value of final discharging lamp voltage in said final discharging lamp voltage storing means is equal to or more than a predetermined value, using said predicted value, or by using said stored value in case less than said predetermined value.

7. A discharging lamp light apparatus according to claim 4, wherein, until said predicting means predicts said final discharging lamp voltage, said characteristic selecting means selects said discharging lamp voltage-current characteristic by using a stored value in case said stored value of final discharging lamp voltage is present in said final discharging lamp voltage storing means, otherwise, by using minimum rated voltage of said discharging lamp if said stored value is not present.

8. A discharging lamp lighting apparatus according to claim 4, further comprising:

predicted final discharging lamp voltage storing means for storing said final discharging lamp voltage predicted by said predicting means, wherein, until said predicting means predicts said final discharging lamp voltage, said characteristic selecting means selects said discharging lamp voltage-current characteristic by, in case said stored value of said final discharging lamp voltage is present in said final discharging lamp voltage storing means, using a stored value of predicted final discharging lamp voltage if a difference between said stored value of said final discharging lamp voltage and said stored value of predicted final discharging lamp voltage in said predicted final discharging lamp voltage storing means is equal to or more than a predetermined value, otherwise, using said stored value of said final discharging lamp voltage if less than said predetermined value, or by using said stored value of said predicted final discharging lamp voltage if only said stored value of said predicted final discharging lamp voltage is present in said predicted final discharging lamp voltage storing means, or by using previously stored minimum rated voltage of a discharging lamp in case both the stored values are not present.

9. A discharging lamp lighting apparatus of claim 1, wherein, said plurality of said discharging lamp voltage-current characteristics each defines a voltage-current transfer function.

10. A method for controlling power supplied to a discharging lamp comprising the steps of:

(a) storing a plurality of discharging lamp voltage-current characteristics indicative of a relationship between discharging lamp voltage and corresponding discharging lamp current of said discharging lamp to obtain a desired amount of emission of the discharging lamp;

(b) predicting a value of final discharging lamp voltage of said discharging lamp;

(c) selecting a one of said discharging lamp voltage-current characteristics identified by final discharging lamp voltage predicted in said step (b); and (d) controlling actual discharging lamp current supplied to said discharging lamp to the current specified by said one of the discharging lamp voltage-current characteristics selected in said step (c).

11. The method of claim 10, wherein, said step (c) comprises the substep of:

utilizing a predetermined minimum rated voltage of said discharging lamp to select said discharging lamp voltage-current characteristic, until said final discharging lamp voltage is predicted in said step (b).

12. The method of claim 10, wherein said step (b) comprises the substep of:

predicting said final discharging lamp voltage by selecting one of predetermined discharging lamp voltage characteristics depending upon discharging lamp voltages at two optional times after the discharging lamp voltage is minimized.

13. The method of claim 10, further comprising the step of:

(e) storing an actual final discharging lamp voltage of said discharging lamp.

14. The method of claim 13, wherein said step (c) comprises the substep of:

selecting said one of the discharging lamp voltage-current characteristics by utilizing said actual final discharging lamp voltage if the actual final discharging lamp voltage is stored in said step (e), or by utilizing said final discharging lamp voltage predicted in said step (b) if said actual final discharging lamp voltage is not stored in said step (e).

15. The method of claim 13, wherein said step (c) comprises the substep of:

selecting said one of the discharging lamp voltage-current characteristics according to said actual final discharging lamp voltage if the actual final discharging lamp voltage is stored in said step (e), or selecting said one of the discharging lamp voltage-current characteristics by utilizing a minimum rate voltage of said discharging lamp if said actual final discharging lamp voltage is not stored in said step (e).

16. A discharging lamp lighting apparatus comprising:

storing means for previously storing at least one discharging lamp voltage-current characteristic indicative of a relationship between discharging lamp voltage and discharging lamp current of the discharging lamp to obtain a desired amount of emission of the discharging lamp; and current control means for controlling actual discharging lamp current supplied to said discharging lamp to the current specified by said discharging lamp voltage-current characteristic stored in said storing means.

* * * * *

UNITED STATES PATENT AND TRADEMARK OFFICE

CERTIFICATE OF CORRECTION

PATENT NO. : 5,465,029 Page 1 of 2

DATED : NOVEMBER 7, 1995

INVENTOR(S) : Y. HANAZAKI and N. UKITA

Figure 13:
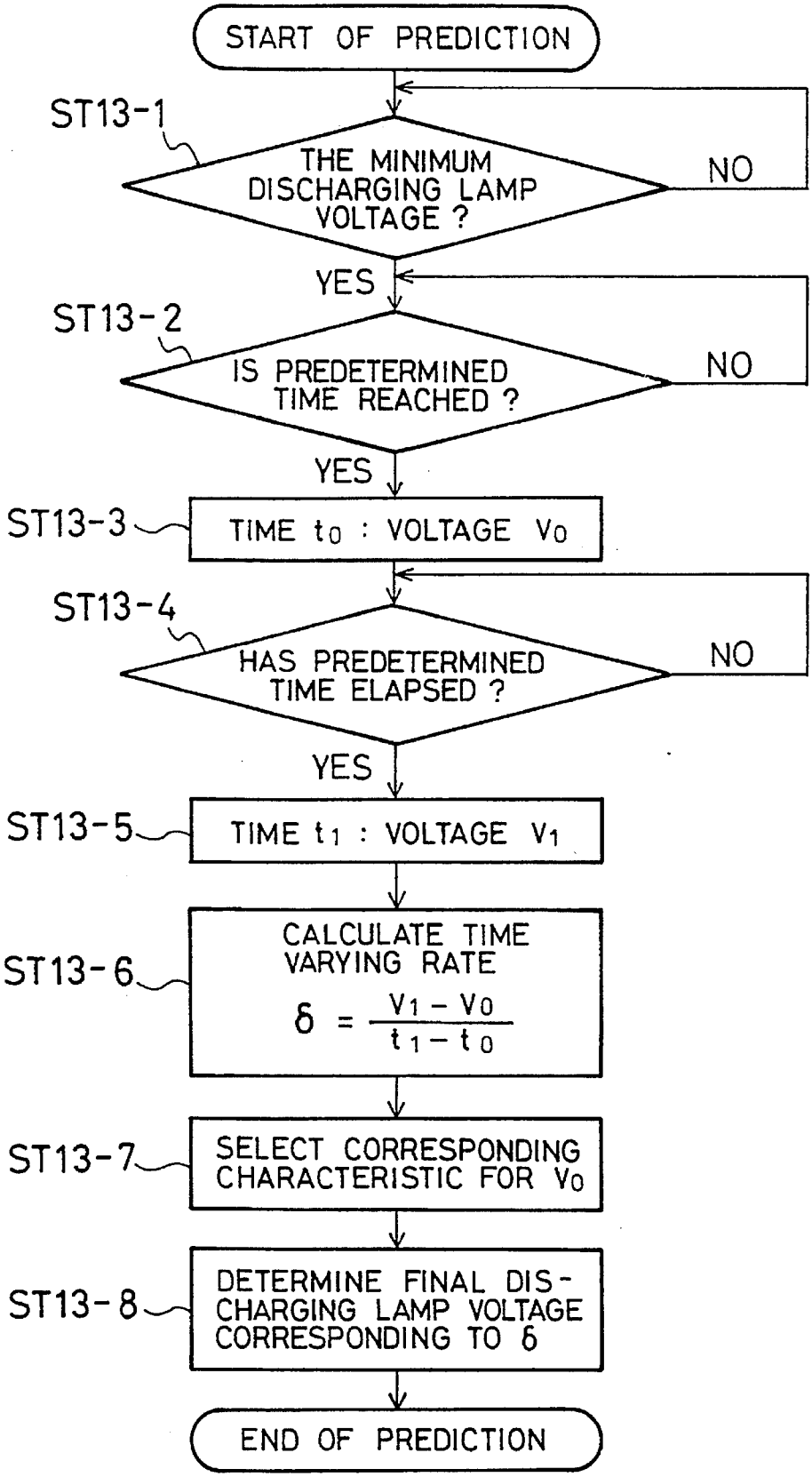
FIG. 13 is a flowchart diagram illustrating a control operation of predicting means according to the embodiment 1.

It is certified that error appears in the above-indentified patent and that said Letters Patent is hereby corrected as shown below:

In the drawings, in Fig. 13, box ST13-7 has been corrected to read --SELECT DISCHARGING LAMP VOLTAGE CHARACTERISTIC FOR $V_0$--;

FIG.13

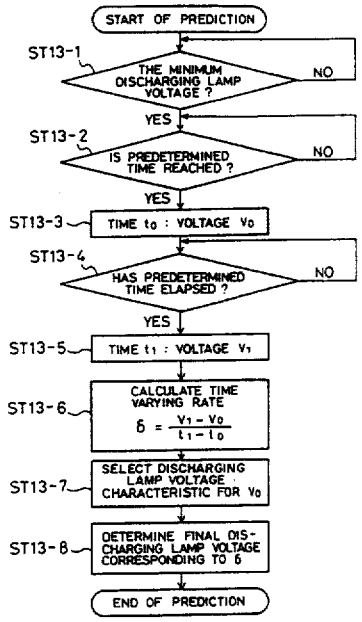

UNITED STATES PATENT AND TRADEMARK OFFICE

CERTIFICATE OF CORRECTION

PATENT NO. : 5,465,029 Page 2 of 2

DATED : NOVEMBER 7, 1995

INVENTOR(S) : Y. HANAZAKI and N. UKITA

It is certified that error appears in the above-indentified patent and that said Letters Patent is hereby corrected as shown below:

In column 19, line 12, change "a corresponding characteristic" to --a discharging lamp voltage characteristic--;

In column 20, lines 13-14, change "discharging lamp voltage-current corresponding characteristics" to --discharging lamp voltage characteristics--;

In column 20, lines 15-16, change "discharging lamp voltage-current corresponding characteristic" to --discharging lamp voltage characteristic--;

In column 33, line 38, change "light" to --lighting--.

Signed and Sealed this

Twenty-eighth Day of May, 1996

*Attest:*

Bruce Lehman

BRUCE LEHMAN

*Attesting Officer*

*Commissioner of Patents and Trademarks*